US008009003B2

(12) United States Patent
Laboure et al.

(10) Patent No.: US 8,009,003 B2
(45) Date of Patent: Aug. 30, 2011

(54) METHOD FOR POWERING A MAGNETIC COUPLER AND DEVICE FOR POWERING AN ELECTRIC DIPOLE

(75) Inventors: Eric Laboure, Cachan (FR); Thierry Antoine Meynard, Beauzelle (FR); François Forest, St Clement de Riviere (FR)

(73) Assignees: Centre National de la Recherche Scientifique (C.N.R.S.), Paris (FR); Institut National Polytechnique de Toulouse, Toulouse (FR); University Montpellier 2, Sciences et Techniques, Montpellier (FR)

( * ) Notice: Subject to any disclaimer, the term of this patent is extended or adjusted under 35 U.S.C. 154(b) by 263 days.

(21) Appl. No.: 12/446,035

(22) PCT Filed: Oct. 22, 2007

(86) PCT No.: PCT/FR2007/001741

§ 371 (c)(1),
(2), (4) Date: Jun. 5, 2009

(87) PCT Pub. No.: WO2008/056045

PCT Pub. Date: May 15, 2008

(65) Prior Publication Data

US 2010/0315187 A1 Dec. 16, 2010

(30) Foreign Application Priority Data

Oct. 20, 2006 (FR) ..... 06 09233

(51) Int. Cl.
*H01F 30/12* (2006.01)

(52) U.S. Cl. ..... 336/12; 336/214

(58) Field of Classification Search ..... 336/12, 336/214, 215

See application file for complete search history.

(56) References Cited

U.S. PATENT DOCUMENTS 2,790,131 A 4/1957 Einard (Continued)

FOREIGN PATENT DOCUMENTS

WO 20060040074 4/2006

OTHER PUBLICATIONS

In Gyu Park et al:, "Modeling and analysis, of multi-interphase transformers for connecting power converters in parallel", Power Electronics Specialists Conference, 1997. PESC '97 Record. , 28TH Annual IEEE St .. Louis, MO, USA Jun. 22-27, 1997, New York, NY, USA, IEEE, US, vol. 2, Jun. 22, 1997, pp. 1164-1170, XPOI0241695.

(Continued)

*Primary Examiner* — Anh T Mai
*Assistant Examiner* — Joselito Baisa
(74) *Attorney, Agent, or Firm* — Young & Thompson

(57) ABSTRACT

A method for powering a magnetic coupler, in which: a) each winding of a first magnetic elementary cell is powered such as to produce a magnetizing flux in a bar of the first cell which is joined with a second cell, the fundamental component of which has an angular offset $x_i$; and b) powering each winding of the second cell such as to produce a magnetizing flux in the bar of the second cell which is joined with the first cell, the fundamental component of which has an angular offset $x_j$. The absolute value of the difference between the angular offsets $x_i$ and $x_j$ is greater than or equal to (I) rad.

16 Claims, 14 Drawing Sheets

U.S. PATENT DOCUMENTS

| | | | | |
|---|---|---|---|---|
| 3,395,373 | A * | 7/1968 | Stephens | 336/12 |
| 4,009,460 | A * | 2/1977 | Fukui et al. | 336/110 |
| 4,112,403 | A | 9/1978 | Friedlander | |
| 4,646,048 | A * | 2/1987 | Hunt et al. | 336/213 |
| 4,853,664 | A * | 8/1989 | Asakura | 336/12 |
| 5,003,277 | A * | 3/1991 | Sokai et al. | 336/10 |
| 5,182,535 | A * | 1/1993 | Dhyanchand | 336/12 |
| 5,416,458 | A * | 5/1995 | Menke et al. | 336/12 |
| 7,449,985 | B2 * | 11/2008 | Urano et al. | 336/178 |
| 2008/0007378 | A1 | 1/2008 | Hanser | |

OTHER PUBLICATIONS

Liu Guangye et al: "Three-Phase-to-Four-Phase Transformer for Four-Phase Power-Transmission Systems" IEEE Transactions on Power Delivery, IEEE Service Center, New York, NY, US, vol. 17, No. 4, Oct. 2002, pp. 1018-1022 , XP011078870 ISSN: 0885-8977.

International Search Report dated Apr. 28, 2008, in PCT application.

* cited by examiner

METHOD FOR POWERING A MAGNETIC COUPLER AND DEVICE FOR POWERING AN ELECTRIC DIPOLE

The present invention relates to a method and device for powering a multi-interphase transformer.

Multi-interphase transformers are used, for example, to connect a load to a multiphase power source. The following article provides further information on multi-interphase transformers: "Modelling and Analysis of Multi-Interphase Transformers for Connecting Power Converters in Parallel", IN GYU PARK and SEON IK KIM, Dept. of Control and Instrumentation Eng., Wonkwang University, Iksan, Chonbuk, 570-749 Korea, IEEE 1997.

It is known to use multiphase power sources which are capable of generating N periodic supply voltages or currents which are offset angularly from one another, N being an integer greater than or equal to four. The angular offsets between the supply voltages or currents used are distributed uniformly between 0 and $2\pi$ rad. An angular offset of $2\pi$ rad corresponds to a period of the voltage or current.

Multi-interphase transformers known to the inventors can be broken down into at least four elementary magnetic cells, each cell comprising:

- a magnetic core suitable for forming a single closed annular magnetic circuit, said core comprising for this purpose at least three non-co-linear bars forming the closed magnetic circuit, at least two of said bars having each a planar face facing the exterior of the cell, and the field lines of the closed magnetic circuit inside said bars being parallel to the planar faces,
- one or more windings, each of said windings being wound around a bar of the magnetic core so as to leave at least the two bars with a planar face free of windings, and
- the elementary cells are joined together in pairs via the respective planar faces thereof so as to form pairs of first and second cells which are magnetically coupled to one another.

The inventors are also familiar with multi-interphase transformers which can be broken down into at least four elementary magnetic cells, each cell comprising:

- a magnetic core suitable for forming only a first and a second closed annular magnetic circuit with a common portion, said core comprising a central magnetic bar forming the common portion of the two closed magnetic circuits, and at least two non-co-linear bars each having a planar face facing towards the exterior of the cell, and the field lines of the first or second closed magnetic circuit inside said bars being parallel to the planar face thereof,
- one or more windings, each of said windings being wound around the central bar so as to leave at least the two bars with a planar face free of windings, and
- the elementary cells are joined together in pairs via the respective planar faces thereof so as to form pairs of first and second cells which are magnetically coupled to one another.

The methods of powering these multi-interphase transformers consist of:

a) powering the or each winding of the first cell with one of the supply voltages or currents so as to produce a magnetising flux in the bar of the first cell joined to the second cell, the fundamental component of which has an angular offset $x_i$, and b) powering the or each winding of the second cell with one of the supply voltages or currents so as to produce a magnetising flux in the bar of the second cell joined to the first cell, the fundamental component of which has an angular offset $x_j$ The absolute value of the difference $x_i$-$x_j$ is equal to $$\frac{2\pi}{N}.$$

Multi-interphase transformers powered in this way function correctly but are bulky.

The object of the invention is therefore to propose a method of powering these multi-interphase transformers which allows the overall size of the multi-interphase transformers to be reduced while maintaining the same performance levels.

The invention therefore relates to a method of powering these multi-interphase transformers, in which the absolute value of the difference between the angular offsets $x_i$ and $x_j$ is greater than or equal to $$\frac{4\pi}{N} \text{ rad.}$$

It has been found that applying an angular offset of greater than or equal to $$\frac{4\pi}{N} \text{ rad}$$

between the angular offsets $x_i$ and $x_j$ reduces the maximum magnetic flux passing through the joined bars. Indeed, this brings the angular offset closer to $\pi$ rad, which corresponds to an optimal reduction in the maximum magnetic flux which can be observed in the joined bars.

Since the maximum magnetic flux passing through the bars is reduced, it is also possible to reduce the dimensions of these bars in such a way that the overall size of the multi-interphase transformer is also reduced.

In addition, owing to the uniform distribution of the angular offsets of the N supply voltages or currents, the voltage or current harmonics in the load powered by this transformer are reduced.

The embodiments of this powering method may comprise one or more of the following features:

- the absolute value of the difference between the angular offsets $x_i$ and $x_j$ is between $$\pi - \frac{2\pi}{N} \text{ rad and } \pi + \frac{2\pi}{N} \text{ rad}$$

for each pair of cells;
- each winding of a cell is connected in series with at least one other winding of another cell.

The invention also relates to a first embodiment of a device for powering an electric dipole, said device comprising:

- a power source with N phases, the angular offsets between the phases being distributed uniformly between 0 and $2\pi$ rad, N being greater than or equal to four and $2\pi$ rad representing a period of the voltage or the periodic current,
- a multi-interphase transformer which can be broken down into at least four elementary magnetic cells, each cell comprising:

a magnetic core suitable for forming a single closed annular magnetic circuit, said core comprising for this purpose at least three non-co-linear bars forming the closed magnetic circuit, at least two of said bars each having a planar face facing the exterior of the cell, and the field lines of the closed magnetic circuit inside said bars being parallel to the planar faces, one or more windings, each of said windings being wound around a bar of the magnetic core so as to leave at least the two bars with a planar face free of windings, and the elementary cells are joined together in pairs via the respective planar faces thereof so as to form pairs of first and second cells which are magnetically coupled to one another, in which:

a) the or each winding of the first cell is connected to a respective phase of the power source so as to produce, during operation, a magnetising flux in the bar of the first cell joined to the second cell, the fundamental component of which has an angular offset $x_i$, and b) the or each winding of the second cell is connected to a respective phase of the power source so as to produce, during operation, a magnetising flux in the bar of the second cell joined to the first cell, the fundamental component of which has an angular offset $x_j$, the absolute value of the difference between the angular offsets $x_i$ and $x_j$ is greater than $$\frac{4\pi}{N} \text{ rad.}$$

The invention also relates to a second embodiment of a device for powering an electric dipole, said device comprising:

a power source with N phases, the angular offsets between the phases being distributed uniformly between 0 and $2\pi$ rad, N being greater than or equal to four and $2\pi$ rad representing a period of the voltage or the periodic current, a multi-interphase transformer which can be broken down into at least four elementary magnetic cells, each cell comprising:

a magnetic core suitable for forming only a first and a second closed annular magnetic circuit with a common portion, said core comprising a central magnetic bar forming the common portion of the two closed magnetic circuits, and at least two non-colinear bars each having a planar face facing towards the exterior of the cell, and the field lines of the first or second closed magnetic circuit inside said bars being parallel to the planar face thereof, one or more windings, each of said windings being wound around the central bar so as to leave at least the two bars with a planar face free of windings, and the elementary cells are joined together in pairs via the respective planar faces thereof so as to form pairs of first and second cells which are magnetically coupled to one another, in which:

a) the or each winding of the first cell is connected to a respective phase of the power source so as to produce, during operation, a magnetising flux in the bar of the first cell joined to the second cell, the fundamental component of which has an angular offset $x_i$, and b) the or each winding of the second cell is connected to a respective phase of the power source so as to produce, during operation, a magnetising flux in the bar of the second cell joined to the first cell, the fundamental component of which has an angular offset $x_j$, the absolute value of the difference between the angular offsets $x_i$ and $x_j$ is greater than $$\frac{4\pi}{N} \text{ rad.}$$

The embodiments of these power devices may comprise one or more of the following features:

the absolute value of the difference between the angular offsets $x_i$ and $x_j$ is between $$\pi - \frac{2\pi}{N} \text{ rad and } \pi + \frac{2\pi}{N} \text{ rad}$$

for each cell;

each winding of the second cell is inferred from the corresponding winding of the first cells by means of axial symmetry along an axis which is co-linear with the joined faces;

each cell comprises at least one first and one second winding wound in opposite directions around the same bar;

each cell comprises at least one first and one second winding, the first winding and the second winding being connected to respective phases of the power source in such a way that, during operation, the angular phase difference between the supply voltages of each of said windings is between $$\pi - \frac{2\pi}{N} \text{ and } \pi + \frac{2\pi}{N}.$$

A clearer understanding of the invention will be achieved upon reading the following description which is given only by way of non-limiting examples and is described in reference to the drawings, in which.

Figure 1:
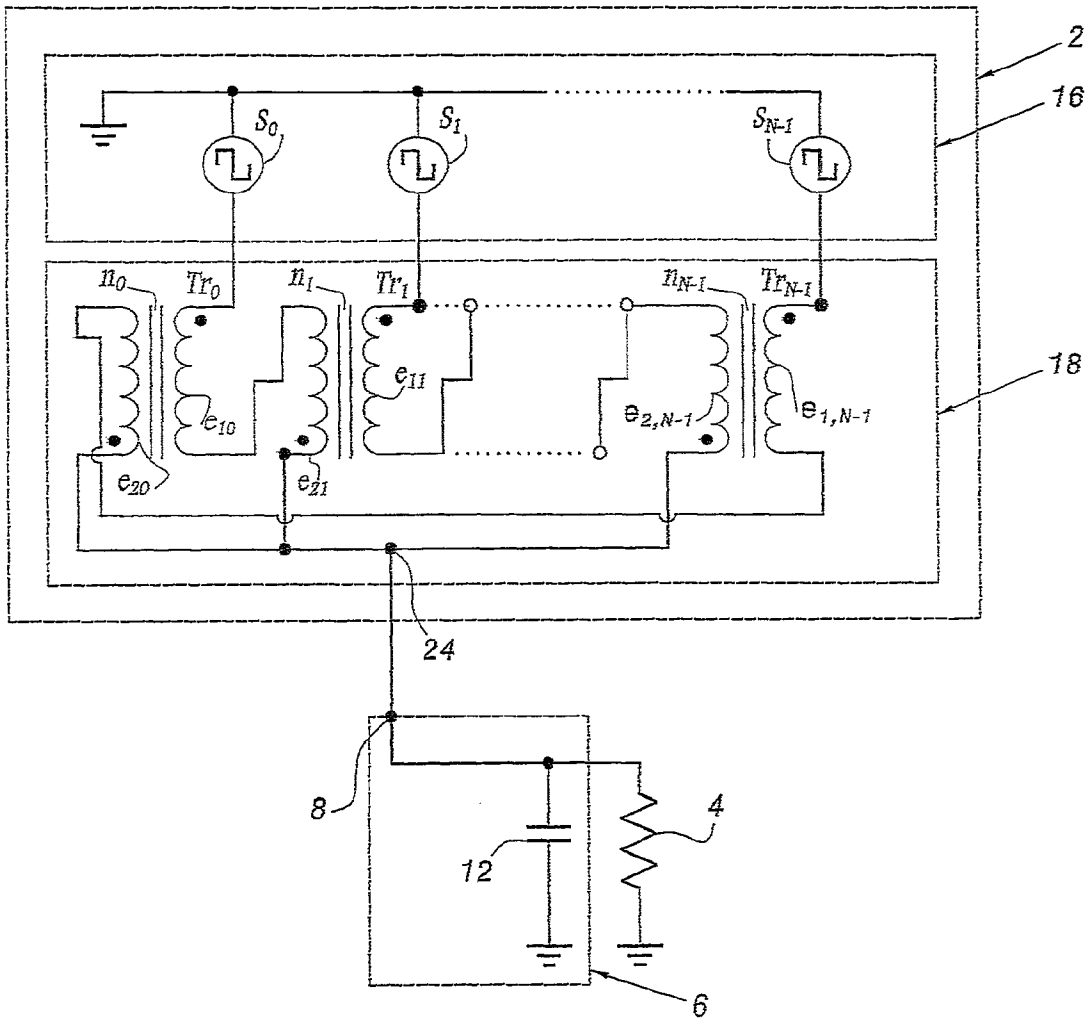
FIG. 1 is a circuit diagram of a device for powering an electric dipole by means of a multi-interphase transformer.

FIG. 1 shows a device 2 for powering an electric dipole 4. In this case, the dipole 4 is connected to the device 2 by a filter 6 provided with an input 8.

The dipole 4 is a resistor for example.

The filter 6 is for example a filter comprising only a filter capacitor 12 connected in parallel with the terminals of the dipole 4. In this case, the device 2 enables a filter choke to be dispensed with.

The device 2 comprises a source 16 of multi-phase voltage and a multi-interphase transformer 18 to connect the source 16 to the dipole 4.

The source 16 is a source with N phases, N being an integer greater than or equal to 4. The source 16 thus supplies N voltages $V_i$, where the reference i is the number of the phase between 0 and N−1. By convention, the angular offset between the voltages $V_0$ and $V_i$ is assumed to be $$\frac{2\pi i}{N} \text{ rad.}$$

Figure 2:
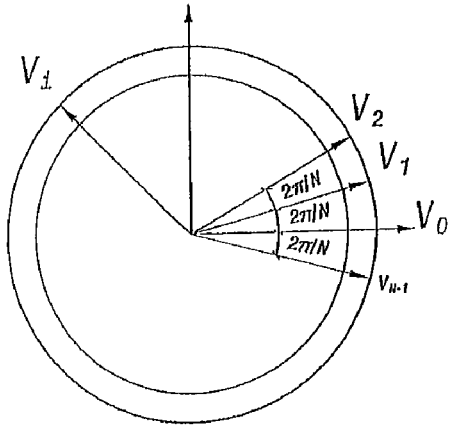
FIG. 2 is a diagram which shows the distribution of the phases of a power source for the device in FIG. 1.

The angular onsets between the voltages $V_0$ to $V_{N-1}$ are thus uniformly distributed between 0 and 2π rad, as shown in FIG. 2.

In FIG. 2, each vector corresponds to a voltage Vi, the modulus of this vector corresponding to the modulus of the fundamental of the voltage and the angle of said vector to the x-axis corresponding to the angular offset thereof from the fundamental of the voltage $V_0$. As shown, when the angular offset of the fundamentals of the voltages $V_0$ to $V_{N-1}$ is uniformly distributed, the angular phase difference between two successive voltage vectors in the diagram in FIG. 2 is equal to 2π/N.

In this case, the amplitudes of the voltages $V_0$ to $V_{N-1}$ are all identical since all the voltages $V_0$ to $V_{N-1}$ have the same periodic waveforms which are offset from one another by an angular offset of $$\frac{2\pi}{N} \text{ rad.}$$

In FIG. 1, the source 16 is shown in the form of N single-phase voltage sources $S_0$ to $S_{N-1}$ supplying the voltages $V_0$ to $V_{N-1}$. For example, the angular offset of the voltage generated by each source $S_i$ can be adjusted so as to correspond to any one of the voltages $V_0$ to $V_{N-1}$. The voltages $V_0$ to $V_{N-1}$ are not generated in order by the sources $S_0$ to $S_{N-1}$, as described below.

For the purposes of simplification of FIG. 1, only three voltage sources $S_0$, $S_1$ and $S_{N-1}$ are shown.

The source 16 is for example a multiphase power supply network, a chopper or a multiphase voltage inverter, a controllable voltage rectifier formed from diodes and thyristors or a first stage of a flyback power supply. Said periodic voltages $V_i$ are not necessarily sinusoidal but are rectangular or triangular, for example, and may comprise a continuous component.

In this embodiment, the multi-interphase transformer 18 comprises N single-phase transformers $Tr_0$ to $Tr_{N-1}$. Each transformer is formed by a primary winding $e_{1i}$ and a secondary winding $e_{2i}$ which are adjacent and magnetically coupled to one another via a magnetic core $n_i$, where i is the same reference as used above.

Each transformer forms a pair of windings which are magnetically coupled to one another by the magnetic core $n_i$.

In order to simplify the figure, only three transformers $Tr_0$, $Tr_1$ and $Tr_{N-1}$ are shown in FIG. 1.

One end of each primary winding $e_{1i}$ is directly connected to the source $S_i$.

The secondary winding $e_{2i}$ of each transformer $Tr_i$ is connected to the source $S_{i-1}$ by the primary winding $e_{1,i-1}$ of the transformer $Tr_{i-1}$. When i is equal to zero, the secondary winding $e_{20}$ is connected to the source $S_{N-1}$ by the winding $e_{1,N-1}$ of the transformer $Tr_{N-1}$.

The end of each secondary winding not connected to one of the sources $S_i$ is directly connected to a common point 24 which is itself directly connected to the input 8 of the filter 6.

The multi-interphase transformer 18 will now be described in greater detail with reference to FIGS. 3 and 4 for the specific case in which the number N of phases is twelve.

Figure 3:
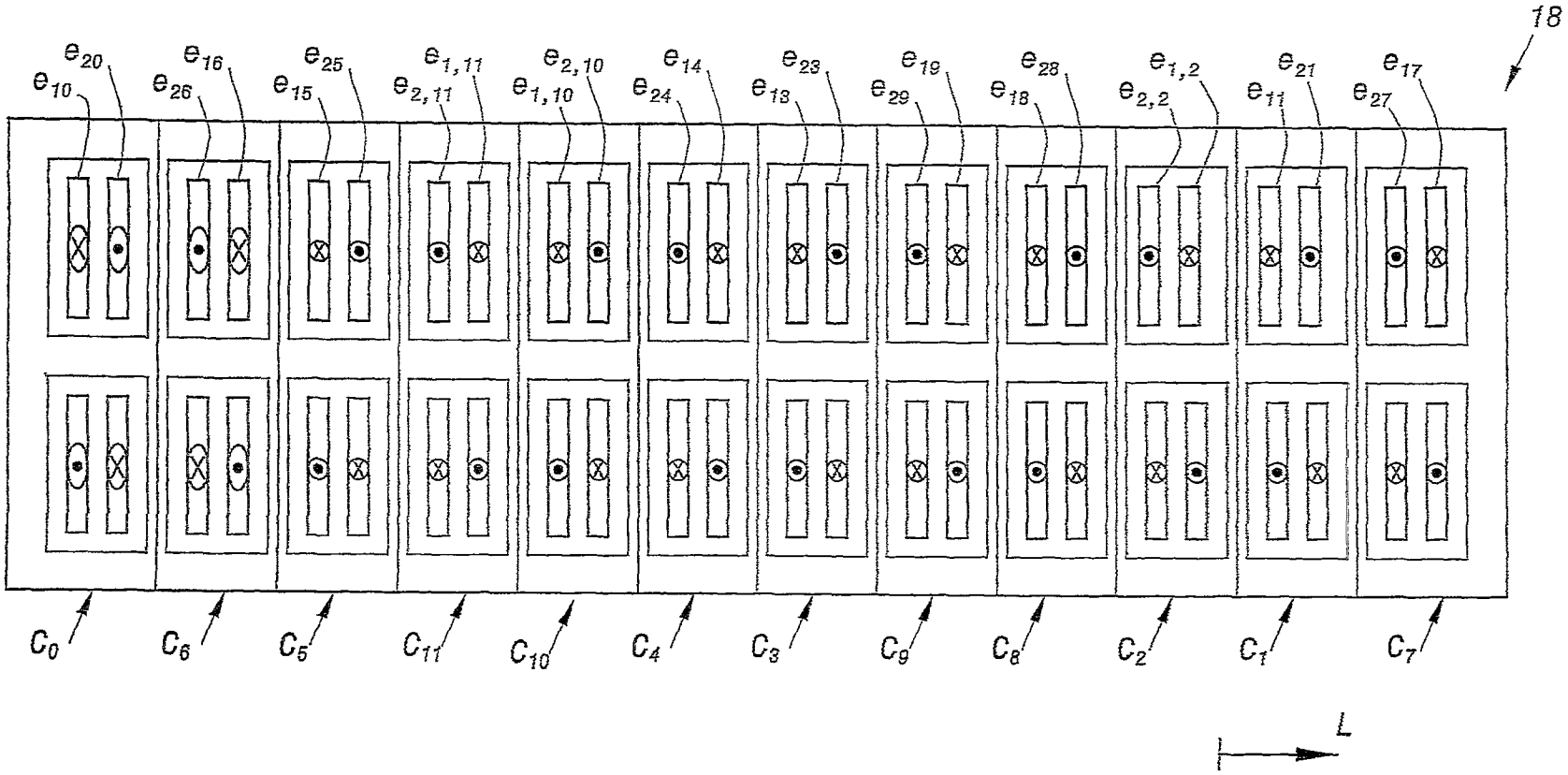
FIG. 3 is a schematic diagram of a first embodiment of a multi-interphase transformer which can be used in the device in FIG. 1.

FIG. 3 is a cross-section of the multi-interphase transformer 18. This multi-interphase transformer 18 is formed from twelve elementary magnetic cells $C_0$ to $C_{11}$ joined to one another in a horizontal direction L. Each cell $C_i$ corresponds to a single-phase transformer $Tr_i$.

Figure 4:
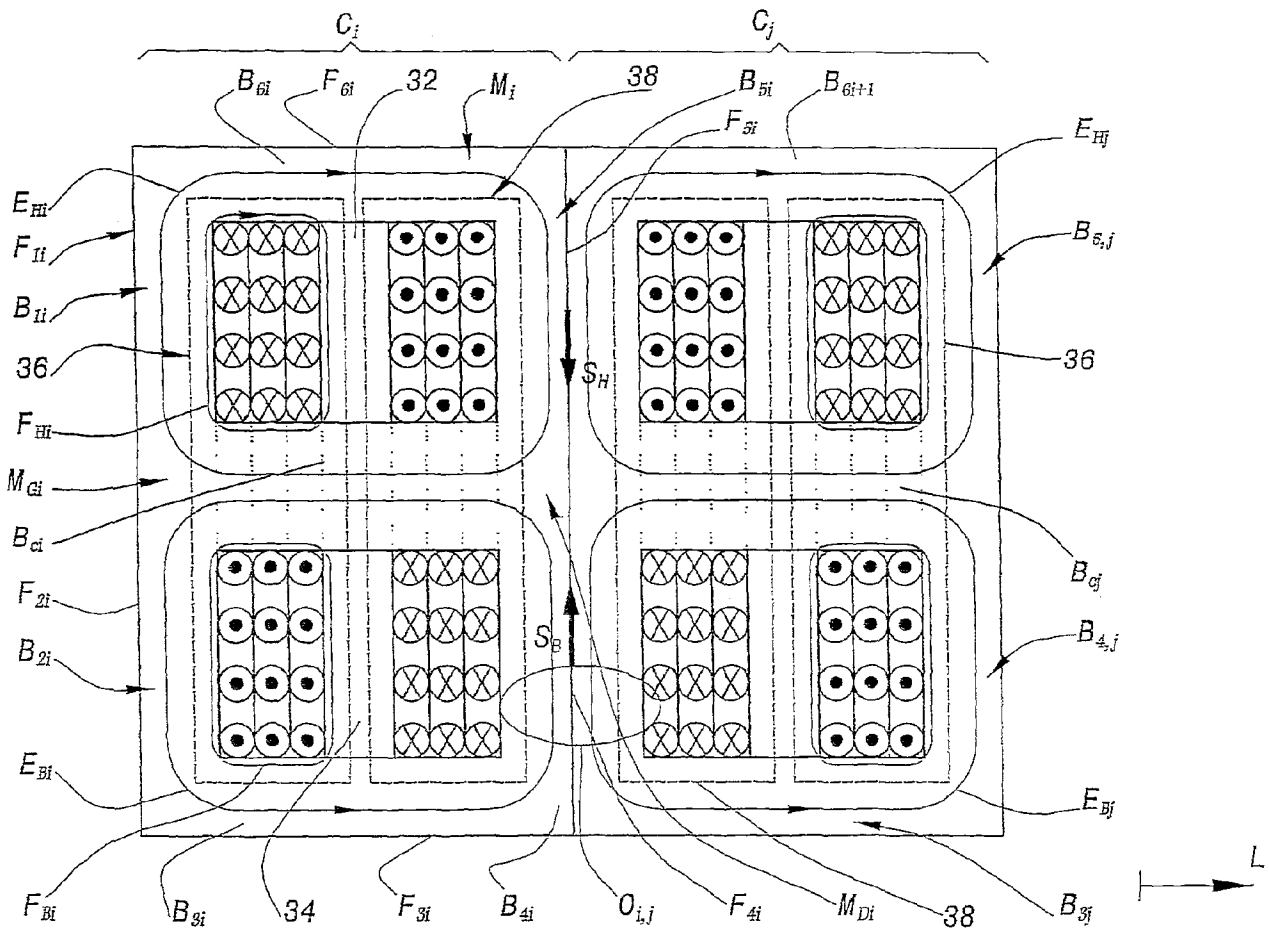
FIG. 4 is a schematic diagram of a first and a second elementary magnetic cells which can be used in the multi-interphase transformer in FIG. 3.

Two adjacent cells $C_i$ and $C_j$ are shown in greater detail in FIG. 4.

Each cell $C_i$ comprises a magnetic core $n_i$ with a cross-section in the shape of a ladder or an "8". To this end, the magnetic core is formed from six lateral bars $B_{1,i}$ to $B_{6,i}$ and a central bar $B_{c,i}$. The bars $B_{1,i}$ and $B_{2,i}$ form the left side-leg $M_{Gi}$ of the ladder. The bars $B_{4,i}$ and $B_{5,i}$ form the right side-leg $M_{Di}$. The side-legs $M_{Gi}$ and $M_{Di}$ may be formed from a single piece.

The bar $B_{ci}$ is a central horizontal bar whereas the bars $B_{3,i}$ and $B_{6,i}$ are horizontal bars located at the top and bottom respectively of the side-legs $M_{Gi}$ and $M_{Di}$.

The cross-section of each of the side-legs or bars is substantially rectangular.

More specifically, the lateral bars $B_{1,i}$ to $B_{6,i}$ each have a planar face, $F_{1,i}$ to $F_{6,i}$ respectively, which face towards the exterior of the cell $C_i$.

The core $n_i$ has two windows or apertures 32 and 34 which are located above and below the central bar $B_{Ci}$ respectively.

The cell $C_i$ also comprises two windings 36 and 38 which are wound around the central bar $B_{Ci}$. The windings 36 and 38 are wound in opposite directions. Each winding preferably comprises a plurality of turns.

The winding direction of the turns of each winding is defined by a dot surrounded by a circle and a circle containing a cross. The dot surrounded by a circle indicates that a vector exits the plane of the page, whereas a circle containing a cross indicates that this vector enters into the plane of the page.

In the following description it shall be considered that the windings wound in a clockwise direction as viewed from the right-hand side of the multi-interphase transformer 18 in FIG. 3 rotate in a positive direction. The windings wound in the opposite direction rotate in a negative direction. The two following references "$V_i$" and "$-V_i$" are defined accordingly.

"$V_i$" is the supply voltage of a winding wound in the positive direction "$-V_i$" is the supply voltage of a winding wound in the negative direction.

Each of said windings 36, 38 corresponds to a winding $e_{2i}$ or $e_{1i}$ of the multi-interphase transformer 18. For this reason, each winding of a cell bears the reference $e_{1i}$ or $e_{2i}$ in FIG. 3. Furthermore, only the direction of winding of each winding has been shown in FIG. 3.

The core $n_i$ concentrates the field lines of the magnetic field created by the windings 36 and 38. These field lines form a magnetising flux. In FIG. 4, two arrows represent two field lines of the magnetising flux $E_{Hi}$ and $E_{Bi}$ created by the windings 36 and 38 within the core $n_i$. These arrows also represent the following sign convention: when the amplitude of the fundamental of the magnetising flux $E_{Hi}$ is positive, the lines of this field $E_{Hi}$ are considered to rotate in the positive direction if they rotate in a clockwise direction. When the amplitude of the fundamental of the magnetising flux $E_{Bi}$ is positive, the lines of this field $E_{Bi}$ are considered to rotate in the positive direction if they rotate in an anticlockwise direction. This sign convention applies to all of the cells $C_i$ of the multi-interphase transformer. The reference $w_i$ is also used to denote the angular offsets of the fundamental components of the magnetic fluxes $E_{Hi}$ and $E_{Bi}$ from the same reference. Using this sign convention, it is possible to indicate that the same magnetising flux can be defined as moving in the positive direction with an offset of $w_i$ or as moving in the negative direction with an offset $w_i+\pi$.

More specifically, the field line of the flux $E_{Hi}$ enters from the right of the central bar $B_{Ci}$ and is closed by passing through the bar $B_{6i}$ at the top when it rotates in a positive direction. The field line $E_{Bi}$ also enters from the right of the bar $B_{6i}$ and is closed by means of the bar $B_{3i}$ at the bottom when said line rotates in the positive direction. These field lines $E_{Hi}$ and $E_{Bi}$ correspond to a magnetising flux created by the windings 36 and 38.

The core $n_i$ thus enables two closed magnetic circuits to be formed. These closed magnetic circuits have a common portion, i.e. the bar $B_{ci}$.

As will be explained below, the amplitude and the phase of the fundamental component of this magnetising flux is a function of the angular offsets of the supply voltages of the windings 36 and 38.

The cell $C_j$ can be inferred from the cell $C_i$ on account of axial symmetry. The cell $C_j$ is thus constructionally identical to the cell $C_i$ with the exception that the positions of the windings 36 and 38 have been swapped in relation to the positions of the windings 36 and 38 of cell $C_i$.

When the windings of the cell $C_j$ are supplied with power, field lines $E_{Hi+1}$ and $E_{Bi+1}$ are formed in the core 30 of the cell $C_j$. The same sign convention as defined for cell $C_i$ also applies to cell $C_j$.

The entire magnetic field generated by the windings 36 and 38 is not concentrated within the core $n_i$. As shown by the arrows $F_{Hi}$ and $F_{Bi}$, magnetic field leakage lines are formed around the winding 36. These lines correspond to a magnetic leakage flux. Unlike the magnetising flux, the magnetic flux leakage lines comprise at least one portion which extends outside the core $n_i$. For example, in this case, the magnetic flux leakage lines pass through the windows 32, 34 in order to close. The windows 32, 34 are formed from air for example.

In this embodiment, the faces $F_{4,i}$, $F_{5,i}$, of the cell $C_i$ are joined, and more specifically are respectively brought into contact with the faces $F_{2,j}$ and $F_{1,j}$ of the cell $C_j$. The magnetising fluxes $E_{Hi}$, $E_{Hj}$ and $E_{Bi}$, $E_{Bj}$ thus merge in the side-legs $M_{Di}$ and $M_{Gj}$.

The side-legs $M_{Di}$ and $M_{Gj}$ are for example adhesively bonded or connected to one another by any means enabling close contact to be maintained between the two side-legs.

The arrows $S_H$ and $S_B$ define a sign convention which applies to all the magnetising fluxes circulating in the joined bars. More specifically, this common sign convention enables the angular offsets of the magnetising fluxes in each cell to be compared.

In this sign convention:

$x^d_i$ indicates the angular offset of the magnetising fluxes $E_{Hi}$ and $E_{Bi}$ in the bar of the cell $C_i$ joined to the cell $C_j$, and $x^g_j$ indicates the angular offset of the magnetising fluxes $E_{Hj}$ and $E_{Bj}$ in the bars joined to those of the cell $C_i$. These references make it possible to note that, in FIG. 4, the offset $x^d_i$ is equal to the offset $w_i$ since the sign conventions used to define these offsets $w_i$ and $x_i$ are in the same direction. Conversely, the offset $x^g_j$ is equal to the offset $w_j+\pi$ rad since the sign conventions used to define the offsets $w_j$ and $x^g_j$ are in the opposite direction.

FIG. 4 likewise shows a face $O_{i,j}$ located at the intersection of the uprights $M_{Di}$ and $M_{Gj}$ and perpendicular to the plane of the page. There are magnetising fluxes $E_{Bi}$ and $E_{Bj}$ across this face $O_{i,j}$. With an identical direction of displacement for the fluxes $E_{Bi}$ and $E_{Bj}$, the greater the difference between the angular offset $x_i$ of the fundamental of the magnetising flux $E_{Bi}$ and the angular offset $x_j$ of the fundamental of the magnetising flux $E_{Bj}$ is, the lower the maximum magnetising flux across the face $O_{i,j}$ is. Also, the lower the magnetising flux across the face $O_{i,j}$ is, the more the horizontal section of the bars $B_{4,i}$ and $B_{2,j}$ can be reduced, and this reduces the overall size of the multi-interphase transformer 18. The same explanations apply to the reduction of the overall size of the bars $B_{5,i}$ and $B_{1,j}$.

The multi-interphase transformer 18 only comprises cells coupled in pairs in the horizontal direction L, i.e. coupled to one another via the faces of the uprights thereof, as was described with reference to FIG. 4.

The design and functionality of the device 2 will now be described with reference to FIG. 5.

Initially, in a step 40 of designing the multi-interphase transformer 18, elementary magnetic cells which are all identical to one another are produced. For example, at this stage each of the cells is identical to the cell $C_i$ described with reference to FIG. 4. Subsequently, the following rules are applied:

a) the supply voltages $V_i$ of each winding of a cell $C_i$ are selected such that an angular offset $\alpha_i$ between the supply voltages of the two windings of said cell is between $$\pi - \frac{2\pi}{N} \text{ and } \pi + \frac{2\pi}{N} \text{ rad,}$$

and b) each cell $C_i$ is coupled to the adjacent cell $C_j$, which, before gluing, generates in the bars of the left upright $B_{1j}$ and $B_{2j}$ the magnetic fluxes $E_{Hj}$ and $E_{Bj}$, of which the angular offset $x_j$ is between $$x_i + \frac{2\pi}{N} + \pi \text{ and } x_i - \frac{2\pi}{N} + \pi.$$

Rule a) corresponds to the application of the teaching of the French patent application filed as FR 05 07 136 and makes it possible to limit the overall size of the multi-interphase transformer 18 even further.

By way of example, the application of rule a) leads to the selection of the voltage pair $V_i$ shown in the following Table for each cell:

Table 1: see annex at the end of the description.

In Table 1, the symbol $C_i$ indicates the cell. In each column $C_i$, the symbols $V_i$ on the left and right identify the corresponding voltages of the windings, on the left and right respectively, of the cell $C_i$.

Since the supply voltages $V_i$ all have the same amplitude, and the angular offset $\alpha_i$ being the same for each of the cells $C_i$, the amplitude of the fundamental of the magnetising flux generated by each of the cells is thus identical. Thus, the application of rule b) consists of:

1) estimating, in an operation 42, the angular offset $w_i$ of the magnetising flux generated by each cell $C_i$ from the supply voltages in Table 1, and
2) joining, in an operation 44, each cell $C_i$ to another cell $C_j$ in such a way that the absolute value of the difference $\gamma$ between the angular offsets $x_i$ and $x_j$ of the magnetising fluxes in the joined bars is between $$\pi - \frac{2\pi}{N} \text{ and } \pi + \frac{2\pi}{N}.$$

The estimation of the angular offset $w_i$ will now be explained using FIG. 6 in the particular case of the cell $C_0$.

Figure 6:
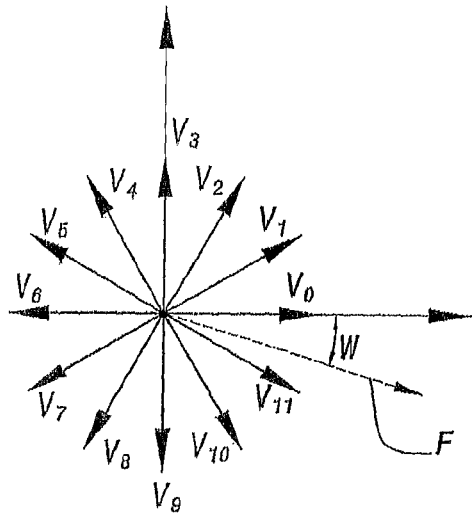
FIG. 6 is a diagram showing the distribution of the phases of a power source with twelve phases.

FIG. 6 corresponds to the graph in FIG. 2 in the case where N is equal to twelve.

Based on Table 1, the voltages $V_0$ and $V_5$ are used to power the windings 36 and 38 respectively of the cell $C_0$.

The angular offset $w_i$ of the magnetising flux can be estimated as the vector sum of the voltage vector $\vec{V}_0$ and the vector $-\vec{V}_5$. The result of this vector summation is shown in FIG. 6 by a dashed arrow F. This arrow F makes an angle $\underline{w}$ of $$\frac{-\pi}{12} \text{ rad}$$

with the x-axis. This angle $\underline{w}$ corresponds to an estimate of the angular offset $w_0$.

It will be noted that to obtain this result it is necessary to take the inverse of the voltage vector $\vec{V}_5$, because the winding 38 is wound in the negative direction.

In the case of the multi-interphase transformer 18, at the end of the operation 42, Table 2 is obtained, the second line of which shows the offsets $w_i$:

Subsequently, during the operation 44, the cells $C_i$ are classified by increasing or decreasing order of angular offset $w_i$.

In the present case, the list of cells classified by increasing order of angular offset $w_i$ is as follows:

$\{C_0, C_5, C_{10}, C_3, C_8, C_1, C_6, C_{11}, C_4, C_9, C_2, C_7\}$.

At this stage, in a first embodiment, the cells are joined to one another in the horizontal direction L in the increasing order shown above. Thus, the bars $B_{5i}$ and $B_{4i}$ of the cell $C_i$ are joined to the bars $B_{1,j}$ and $B_{2,j}$ respectively of the following cell $C_j$.

In this first embodiment, it is checked that the difference $\gamma$ between the angular offsets $x^d_i$ and $x^g_j$ is approximately $\pi$ rad. For example, the angular offset $w_0$ is in this case equal to $-\pi/12$ whilst the angular offset $w_5$ is equal to $\pi/12$ rad. The offset $x^d_i$ in the bar $B_{50}$ is therefore equal to $-\pi/12$ rad. The offset $x^g_5$ in the bar $B_{15}$ is equal to $w_5+\pi$, i.e. $\pi/12+\pi$, because in the bar $B_{15}$, the sign convention adopted for defining the offset of the flux $E_{H5}$ is in the opposite direction of the arrow $S_H$. The difference $\gamma$ is therefore equal to $\pi+2\pi/12$ rad in this case.

In the first embodiment, the offsets $w_i$ are distributed over 360° and the continuous components of the magnetic fluxes in the joined bars do not cancel out.

To obtain a second embodiment of the multi-interphase transformer, in which the differences $\gamma$ are even closer to $\pi$ rad, a step 46 of permuting the supply voltages is performed.

More precisely, in step 46, using Table 2, the cells are divided into two halves in such a way that the angular offset $w_i$ of each cell in the first half is less than all the angular offsets $w_i$ of the cells in the second half. For example, in this case, the second half consists of the last six cells in the classification in increasing order shown above, i.e. in this case the cells $C_6$, $C_{11}$, $C_4$, $C_9$, $C_2$ and $C_7$.

Subsequently, the supply voltage of the left winding of each of the cells in this second half is permuted with the supply voltage of the right winding of the same cell. This permutation of the supply voltages does not alter the position of the windings 36 and 38. Thus, using the notations defined with reference to Table 1, this operation of permuting the voltages of a cell makes it possible to pass from the couple of supply voltages $(V_a, -V_b)$ to the supply couple $(V_b, -V_a)$.

In contrast, the operation of permuting the voltages reverses the direction in which the fundamental component of the magnetic flux rotates. The angular offset $w_i$ of each permuted cell is thus incremented by $\pi$ rad. The second line of Table 3 below shows the angular offset $w_i$ of each cell $C_i$ at the end of step 46:

TABLE 2

| $C_0$ | $C_1$ | $C_2$ | $C_3$ | $C_4$ | $C_5$ | $C_6$ | $C_7$ | $C_8$ | $C_9$ | $C_{10}$ | $C_{11}$ |
|---|---|---|---|---|---|---|---|---|---|---|---|
| $-\frac{\pi}{12}$ | $\frac{9\pi}{12}$ | $\frac{19\pi}{12}$ | $\frac{5\pi}{12}$ | $\frac{15\pi}{12}$ | $\frac{\pi}{12}$ | $\frac{11\pi}{12}$ | $\frac{21\pi}{12}$ | $\frac{7\pi}{12}$ | $\frac{17\pi}{12}$ | $\frac{3\pi}{12}$ | $\frac{13\pi}{12}$ |

TABLE 3

| $C_0$ | $C_5$ | $C_{10}$ | $C_3$ | $C_8$ | $C_1$ | $C_6$ | $C_{11}$ | $C_4$ | $C_9$ | $C_2$ | $C_7$ |
|---|---|---|---|---|---|---|---|---|---|---|---|
| $-\frac{\pi}{12}$ | $\frac{\pi}{12}$ | $\frac{3\pi}{12}$ | $\frac{5\pi}{12}$ | $\frac{7\pi}{12}$ | $\frac{9\pi}{12}$ | $-\frac{\pi}{12}$ | $\frac{\pi}{12}$ | $\frac{3\pi}{12}$ | $\frac{5\pi}{12}$ | $\frac{7\pi}{12}$ | $\frac{9\pi}{12}$ |

It can thus be seen that the angular offsets of the set of cells are now distributed over 180°, and no longer over 360°.

Subsequently, still in step 46, the cells $C_i$ thus obtained are again classified by increasing order of angular offset $w_i$. The following classification is thus obtained:

$\{C_0, C_6, C_5, C_{11}, C_{10}, C_4, C_3, C_9, C_8, C_2, C_1, C_7\}$.

In this second embodiment, the cells $C_i$ thus obtained are then joined in the horizontal direction L in the order shown above.

The first line of Table 4 (see annex) shows the order of the cells in this second embodiment. The second line shows the voltage at which each of the windings of each cell is connected.

It is checked that in the second embodiment the difference $\gamma$ obtained is closer to $\pi$ rad than in the first embodiment. For example, the angular offsets $w_0$ and $w_6$ of the joined cells $C_0$ and $C_6$ are both equal to $-\pi/12$ rad. Consequently, the angular offset $x^d_0$ in the bar $B_{50}$ before gluing is equal to $-\pi/12$ rad. The angular offset $x^g_6$ in the bar $B_{16}$ before gluing is equal to $-\pi/12+\pi$. In fact, as before, the sign convention for defining the offset $w_6$ is in the opposite direction from the arrow $S_H$. Thus, in the bar $B_{16}$, the offset $x^g_6$ is given by the following relationship: $x^g_6=w_6+\pi$.

The difference $\gamma$ is equal to $\pi$ rad.

It will also be noted that the difference $\gamma$ between the joined bars of the cells $C_6$ and $C_5$ is equal to $\pi+2\pi/12$ rad.

Thus, the maximum amplitude of the fundamental of the magnetising flux in the joined uprights of a pair of cells is substantially zero. Moreover, the maximum amplitude of the magnetising flux generated within the joined uprights of two cells belonging to different pairs is greatly reduced. This makes it possible to reduce greatly the section of these uprights and therefore the overall size of the multi-interphase transformer 18.

This second embodiment therefore makes it possible to make the difference $\gamma$ even closer to $\pi$ rad. However, neither the first nor the second embodiment makes it possible to cancel the continuous components of the magnetising fluxes in the joined bars.

To cancel this continuous component in the joined bars, a step 48 of permuting the positions of the coils is then performed. The step 48 is in this case applied to half of the cells. Step 48 may be performed after step 46 or straight after step 40.

In step 48, the first two cells of the list of cells classified by increasing order are grouped to form a first pair, then the following two cells are grouped to form a second pair, and so on.

Subsequently, for the second element of each pair, the position of the two coils of the cell is permuted relative to the position on which the classifying operation was based. For example, in the case of the cell $C_6$, in the operation 46, the windings 36 and 38 are on the left and right of the cell respectively. Once the positions have been permuted, the windings 36 and 38 are on the right and left of the cell respectively.

Subsequent to a permutation of this type, the windings immediately to the right and left of a joined bar are wound in the same direction. A configuration of this type reduces or cancels the continuous components of the magnetising fluxes in the joined bars. Moreover, the permutation of the position of the windings does not alter the angular offset $w_i$ of the cell, because the windings 36 and 38 are still supplied with the same voltages. Finally, only the position of the windings is altered. Under these conditions, step 48 makes it possible, in addition to the reduction of the maximum amplitude of the fundamental component of the magnetising flux in the joined bars, also to reduce the continuous component in said joined bars.

For example, Table 5 below shows the supply voltages, of each cell of the multi-interphase transformer, obtained at the end of steps 46 and 48. The first line shows the order of the cells. The second line shows the supply voltages of the left and right coils of each cell.

Table 5 (See Annex)

After design, in a step 50, the angular offset of each supply $S_0$ to $S_{N-1}$ is controlled in such a way that the supply voltage of the first windings $e_{1i}$, $e_{2i}$ of each cell $C_i$ corresponds to that which was determined in the design step 40.

Consequently, in a step 52, the windings of each cell are powered using the source 16 controlled in this way. This makes it possible to supply the dipole 4 from a multiphase supply.

The multi-interphase transformer 18 has been described in the particular case where it is formed of twelve cells. However, what has been described above is applicable to any multi-interphase transformer formed of at least four cells. By way of example, Tables 6 and 7 below describe the configuration of multi-interphase transformers having from 4 to 20 cells obtained by performing operations 46 and 48.

More precisely, in each of these Tables 6 and 7, column "N" shows the total number of cells and the following columns show what supply voltages are to be used for each cell $C_i$ to power the windings thereof. In these Tables, each column $C_i$ is divided into two sub-columns. The left and right sub-columns show the supply voltage at which the left and right windings respectively of this cell must be connected. In these sub-columns, the absolute value of the number j shown indicates that this winding must be supplied with the voltage $V_{j-1}$. The "–" symbol before the number j simply indicates that this winding is wound in the negative direction.

Table 6 (See Annex)

Table 7 (See Annex)

Figure 7:
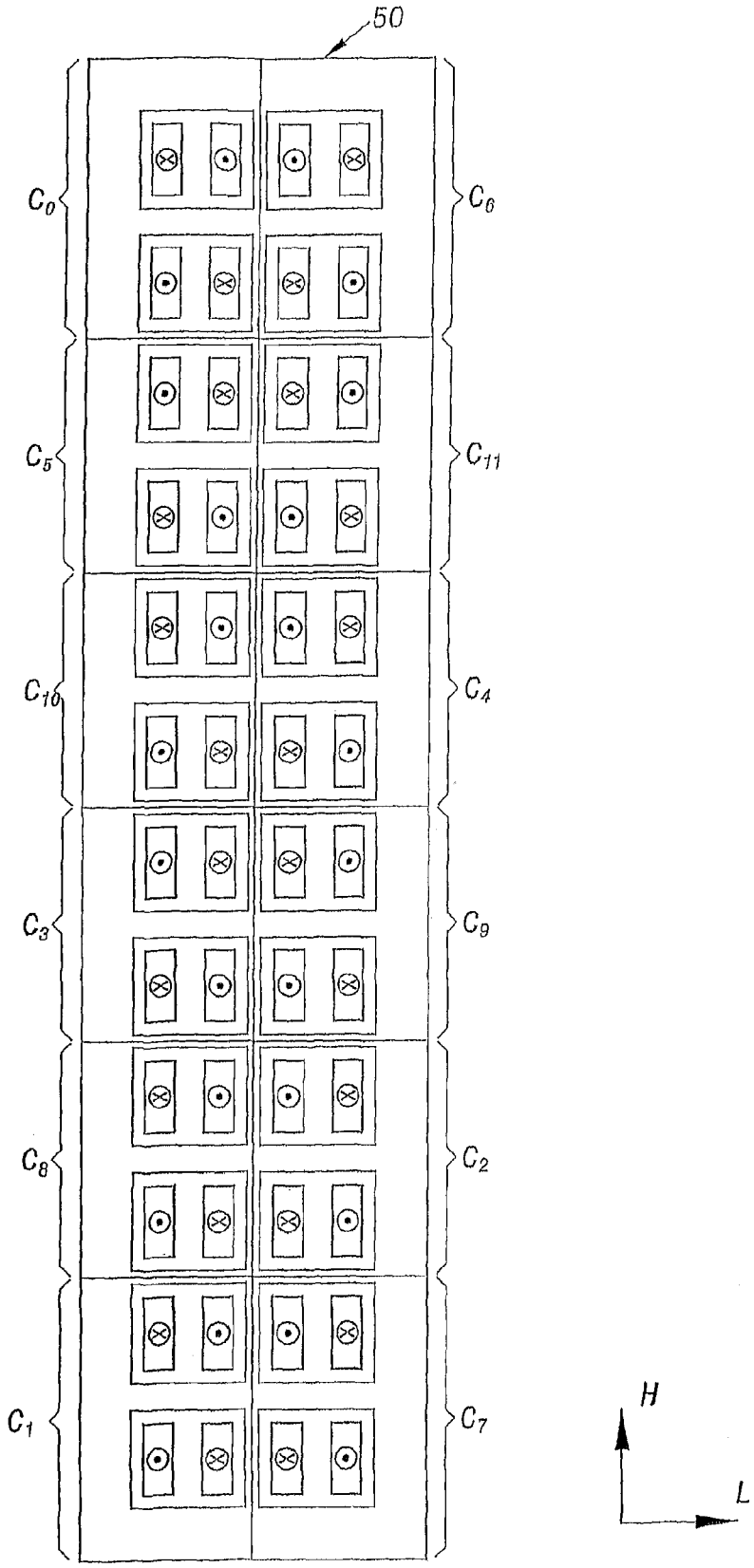
FIG. 7 is a schematic diagram of the construction of another embodiment of a multi-interphase transformer which can be used in the device in FIG. 1.

FIG. 7 shows a multi-interphase transformer 50 which can be used instead of and in the place of the multi-interphase transformer 18 in the device 2.

This multi-interphase transformer 50 likewise comprises twelve cells $C_i$ which are respectively identical to the cells $C_i$ of the multi-interphase transformer 18. In contrast to the multi-interphase transformer 18, the cells $C_i$ of the multi-interphase transformer 50 are joined not only in the horizontal direction L, as in the multi-interphase transformer 18, but also in a vertical direction H.

More precisely, each pair of cells ($C_0$; $C_6$); ($C_5$; $C_{11}$); ($C_{10}$; $C_4$); ($C_3$; $C_9$); ($C_8$; $C_2$) and ($C_1$; $C_7$) is joined in a horizontal direction via the respective vertical uprights thereof. Moreover, each pair of cells is also joined in the vertical direction H to another pair of cells via the horizontal bars thereof. The cells are joined in the vertical direction in the same way as in the horizontal direction, i.e., for example, by directly contacting the planar faces of the lateral bars of these cells. These cells may be fixed in the vertical direction by gluing or by any other means.

As in the case of the multi-interphase transformer 18, the supply voltages of each of the windings of each cell are determined as a function of the angular offsets $w_i$ of the magnetising fluxes.

For example, when the multi-interphase transformer 50 is designed, the procedure is the same as was described with reference to operations 42 to 48 until Table 5 is obtained. Then, alternately, for every other cell, the following operations are carried out:

permuting the supply voltages of each of the cells of these pairs, and permuting the positions of the windings of each of these cells.

In this case, these operations are therefore applied to the following pairs of cells: $\{C_5; C_{11}\}$, $\{C_3; C_9\}$ and $\{C_1; C_7\}$.

The permutation of the supply voltages is identical to operation 46 and thus makes it possible to add an offset of $\pi$ rad, allowing the fundamental component to be cancelled in the joined horizontal bars.

The step of permuting the windings is identical to operation 48 and thus makes it possible to cancel the continuous component of the magnetising flux in the joined horizontal bars.

At the end of these steps, the distribution of voltages shown in the Table below is obtained for each cell:

Table 8 (See Annex)

It is then checked that the difference $\gamma$ between, for example, the offset $x_5$ in the bar $B_{65}$ and the offset $x_0$ in the bar $B_{30}$ is approximately $\pi$ rad. In this case, $w_0$ and $w_5$ are equal to $-\pi/12$ and $\pi/12+\pi$ respectively. If the common sign convention for the bars $B_{30}$ and $B_{65}$ is such that the magnetising flux is positive when it is displaced from left to right in the joined bars, then $x^b{}_0=-\pi/12$ rad and $x^h{}_5=\pi/12+\pi$, where $x^b{}_0$ and $x^h{}_5$ are the angular offsets in the bars $B_{30}$ and $B_{65}$ respectively. Therefore the difference $\gamma$ is equal to $\pi$ rad.

Thus, in the multi-interphase transformer 50, the overall size of the joined vertical uprights and of the joined horizontal bars can be greatly reduced.

Figure 8:
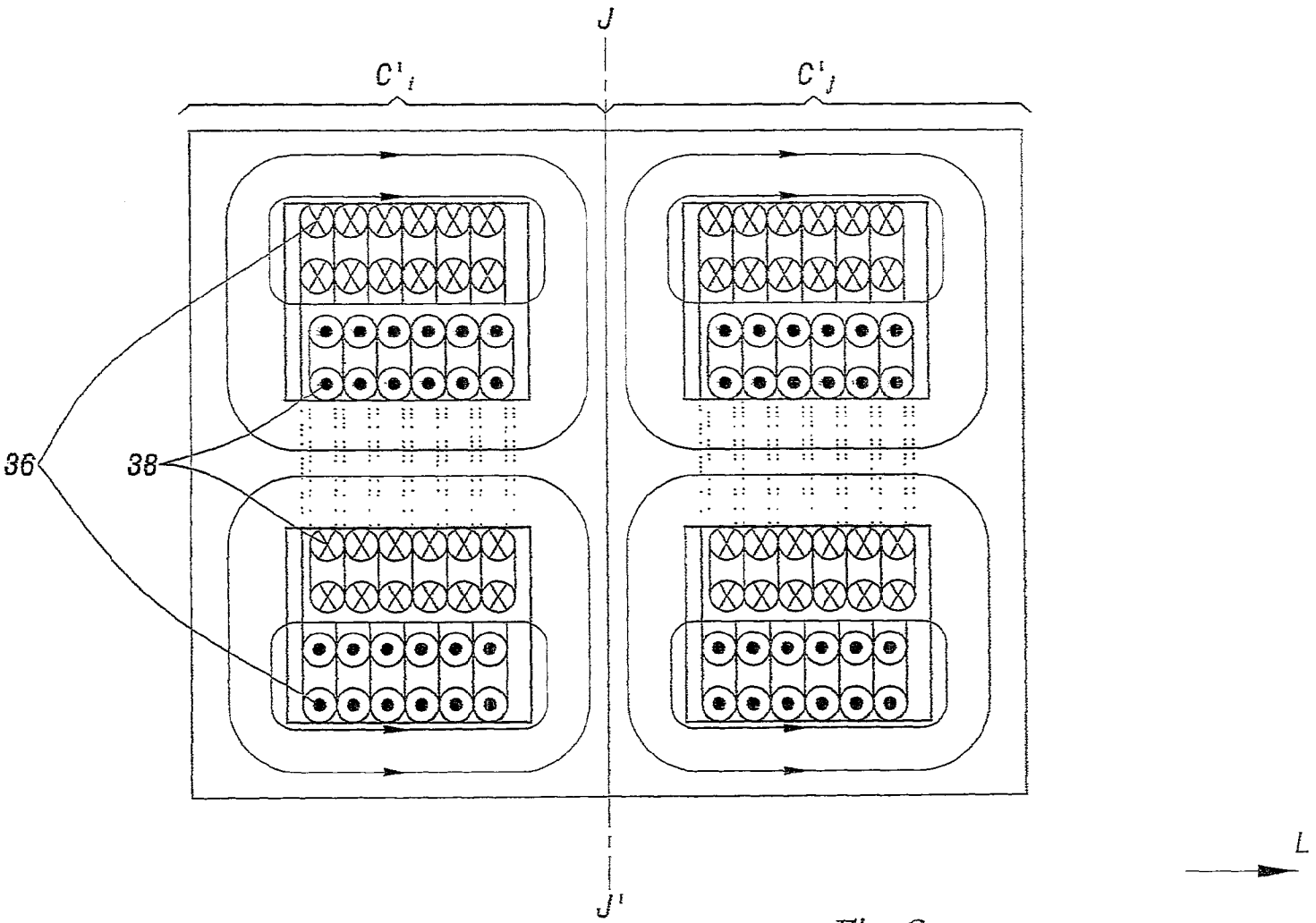
FIGS. 8 to 11 are schematic diagrams of different embodiments of elementary magnetic cells which can be used in the multi-interphase transformers in FIGS. 3 and 7.

FIG. 8 shows another embodiment of the cells $C'_i$ and $C'_j$ which can be used instead of and in the place of the cells $C_i$ and $C_j$ respectively.

The construction of the cell $C'_i$ is identical to that of the cell $C_i$ except that the winding 36 is wound around the winding 38 and not to the side. For example, the winding 36 is wound on the periphery of the winding 38.

For example, the cell $C'_j$ is identical to the cell $C'_i$.

Figure 9:
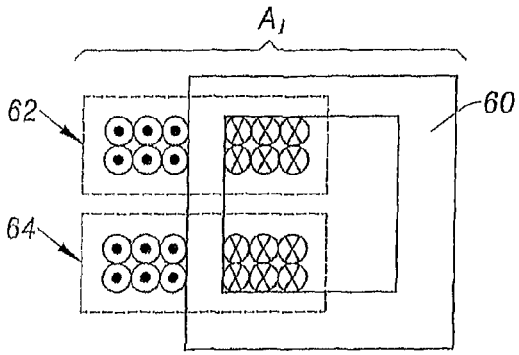
Figure 10:
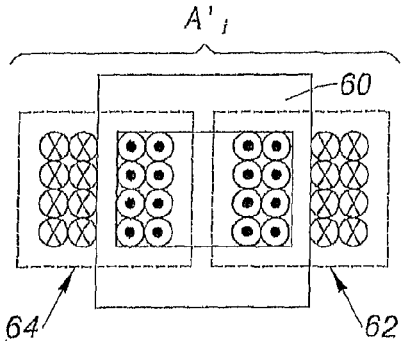
Figure 11:
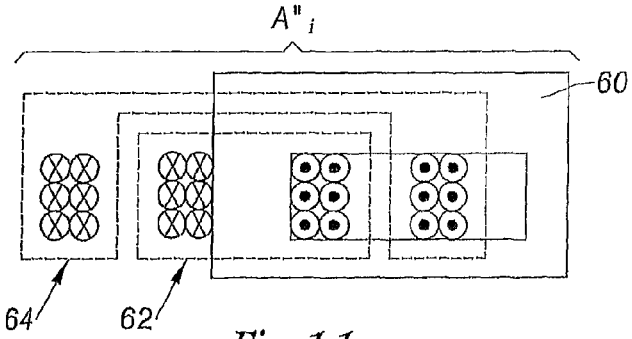

FIGS. 9 to 11 show cells $A_i$, $A'_i$ and $A''_i$ respectively, comprising a core 60 having an annular cross-section in a vertical plane. In this case, the core 60 is formed of two horizontal bars and two vertical bars.

These cells $A_i$, $A'_i$ and $A''_i$ each comprise only two windings 62 and 64 wound in the opposite direction from one another. In the cells $A_i$ and $A''_i$, the windings 62 and 64 are wound around the same bar. In the cell $A_i$, the winding 62 is only wound around an upper part of the vertical bar, whilst the winding 64 is only wound around a lower part of the same bar.

In the cell $A''_i$, the winding 64 is wound around the winding 62 and preferably around the periphery of the winding 62.

In the cell $A'_i$, the winding 62 is only wound around a vertical bar of the cell, whereas the winding 64 is only wound around the other vertical bar of the cell.

The free bars of each coil of the cells $A_i$, $A'_i$ and $A''_i$ each have a planar face pointing towards the outside of the cell. These planar faces make it possible to join the cells to one another to form a multi-interphase transformer. The supply voltage of each of these windings is selected as a function of the angular offset $x_i$ of the fundamental of the magnetising flux concentrated in the joined bars. For this purpose, the teaching provided with reference to FIG. 5 is adapted for the case involving the cells $A_i$, $A'_i$ and $A''_i$ so as to minimise the maximum amplitude of the fundamental of the magnetising flux in these bars which are joined to one another.

Finally, the cells $A_i$, $A'_i$ and $A''_i$ are basically distinguished from the cells $C_i$ and $C'_i$ in that in the cells $A_i$, $A'_i$ and $A''_i$, a single annular closed magnetic circuit is established, whereas in the cells $C_i$ and $C'_i$, two annular closed magnetic circuits are established on different paths.

Figure 12:
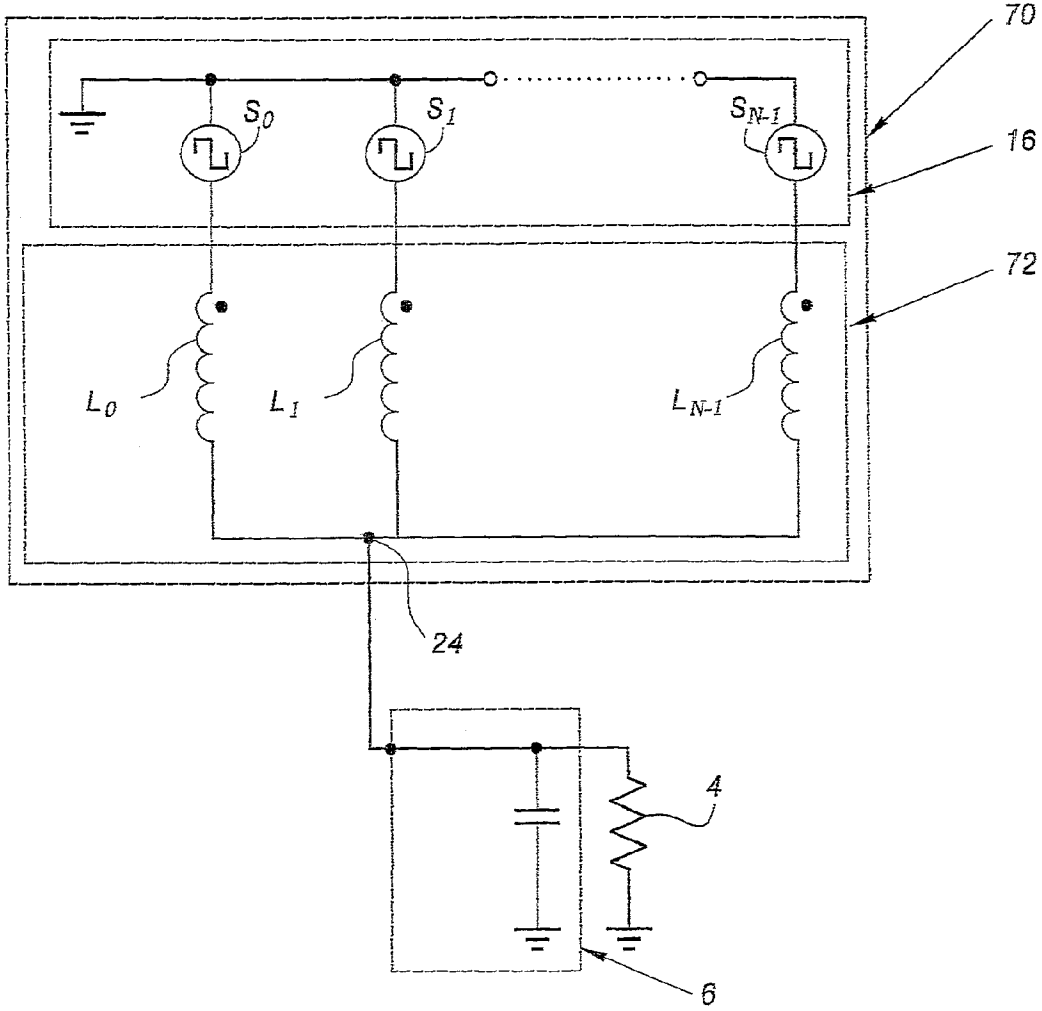
FIG. 12 is a circuit diagram of another embodiment of a device for powering an electric dipole by means of a multi-interphase transformer.

FIG. 12 shows another supply device 70 for the electric dipole 4. For this purpose, this device 70 comprises the power source 16 as well as a multi-interphase transformer 72 for connecting the N phases of the source 16 to the dipole 4.

More precisely, the multi-interphase transformer 72 comprises N windings $L_i$ producing inductance. Only one side of each winding $L_i$ is connected to the source $S_i$, the other side being connected to the common point 24.

The construction of the multi-interphase transformer 72 is described in greater detail with reference to FIG. 13 in the particular case where the number N of phases is equal to five.

The multi-interphase transformer 72 is produced by joining five identical elementary magnetic cells $B_0$ to $B_4$ in the vertical direction H. The cell $B_i$ is described in greater detail with reference to FIG. 14.

In this example, the cell $B_i$ comprises a magnetic core 74 having an anular cross-section. This core 74 is formed of only two vertical bars and two horizontal bars. In this case, the three bars without coils each have a planar face pointing towards the outside and allowing this cell to be magnetically coupled to another cell. At least one of the bars comprises a gap 75 for preventing saturation of the core 74 caused by a continuous component of the magnetising flux.

Figure 14:
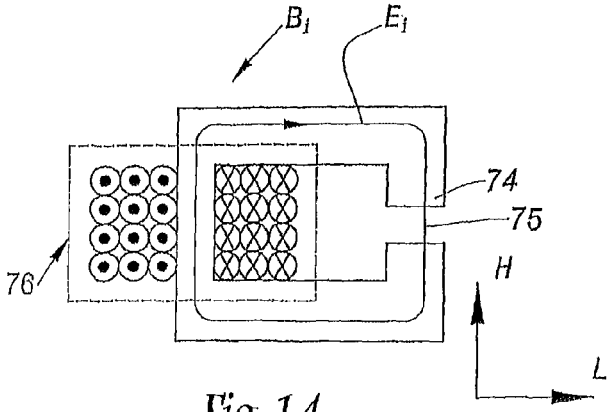
FIGS. 14 and 15 are schematic diagrams of elementary magnetic cells which can be used in the multi-interphase transformer of FIG. 13.

The cell $B_i$ likewise comprises only a single winding 76, wound around only one of the vertical bars. This winding 76 generates a magnetising flux $E_i$ concentrated in the interior of the core 74. A single field line of the magnetising flux $E_i$ is shown in FIG. 14. This magnetising flux has an angular offset $w_i$ which is a function of the angular offset of the supply voltage of the winding 76. More precisely, in the case of the cell $B_i$, the estimate of the angular offset $w_i$ is set equal to the angular offset of the supply voltage of the winding 76.

Figure 13:
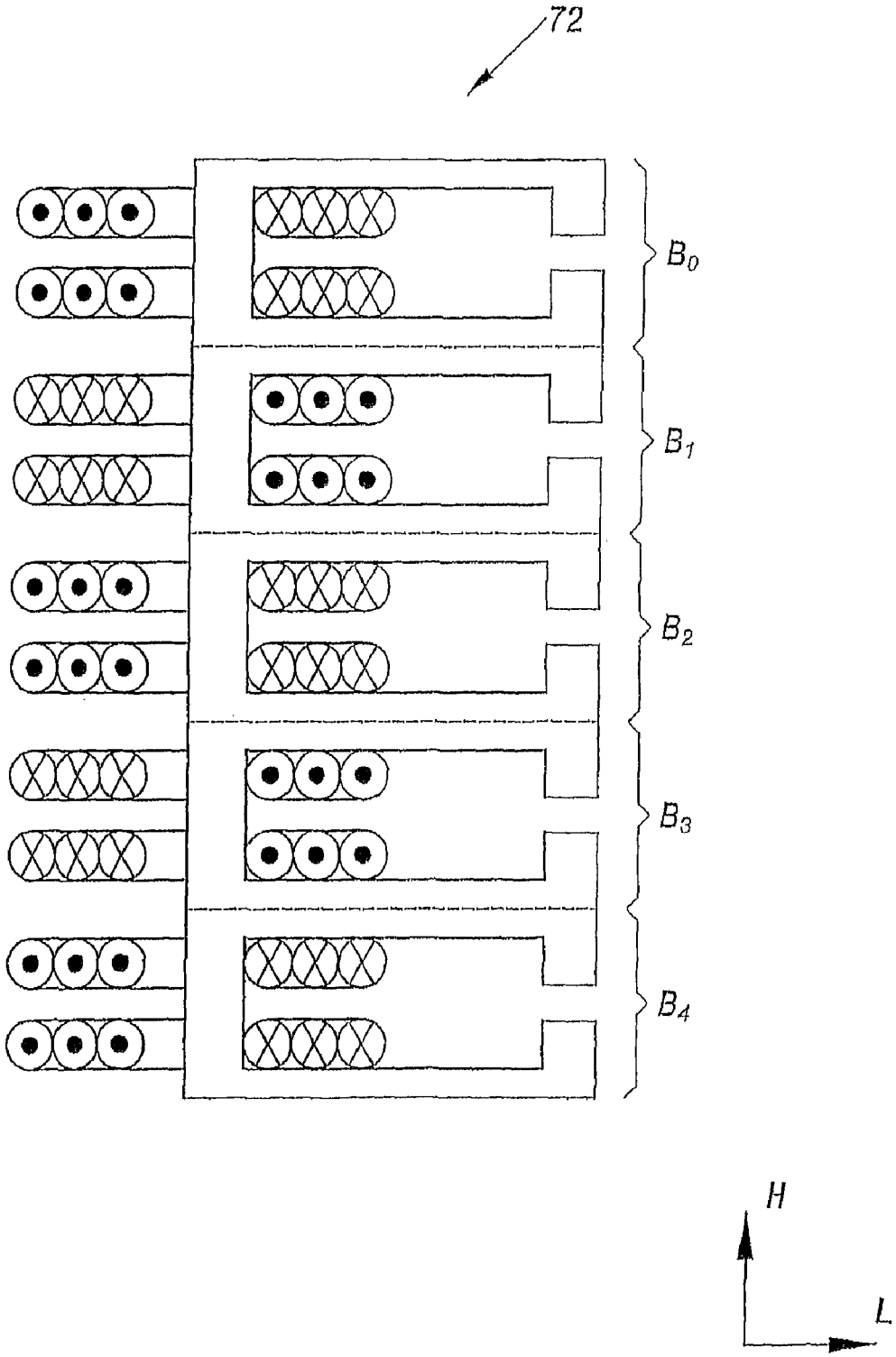
FIG. 13 is a schematic diagram of a multi-interphase transformer which can be used in the device in FIG. 12.

In FIG. 13, the cells $B_i$ are joined to one another so as to be juxtaposed edge to edge with the planar faces of the respective horizontal bars thereof.

As before, the angular offset of the supply voltage of the windings of the cell $B_i$ is determined in such a way as to minimise the amplitude of the fundamental of the magnetising flux circulating in the joined bars. More precisely, the supply voltages of joined cells $B_i$ and $B_j$ are selected in such a way that the difference between the angular offsets $x_i$ and $x_j$ of the fundamentals of the magnetising fluxes generated by each of these cells is as close as possible to $\pi$ rad.

Figure 5:
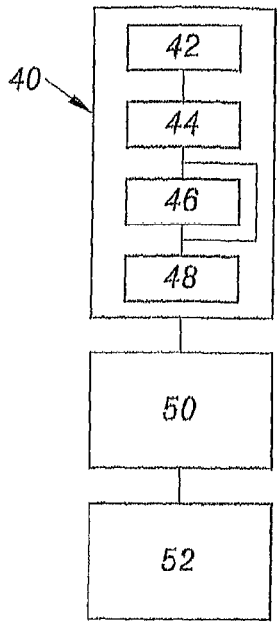
FIG. 5 is a flowchart of a method of powering the multi-interphase transformer in FIG. 3.

The method described with reference to the procedure of FIG. 5 is adapted to produce the multi-interphase transformer 72. For example, in FIG. 13, the windings of the cells $B_1$ to $B_4$ are all wound in the same direction. Thus, in this configuration, the windings of the cells $B_0$ to $B_4$ are supplied with the voltages $V_1$, $V_3$, $V_5$, $V_2$, and $V_4$ respectively.

Figure 15:
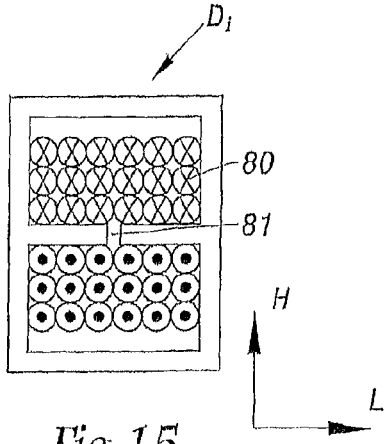

FIG. 15 shows the architecture of a cell $D_i$ having a core identical to the core $n_i$ of the cell $C_i$. The cell $D_i$ is only provided with a single winding 80 wound around the central bar. The central bar comprises a gap 81 for avoiding the saturation of the core $n_i$ caused by a continuous component of the magnetising flux. This cell $D_i$ can be used instead of and in the place of the cell $B_i$ in multi-interface transformers similar to the multi-interphase transformer 72.

Figure 16:
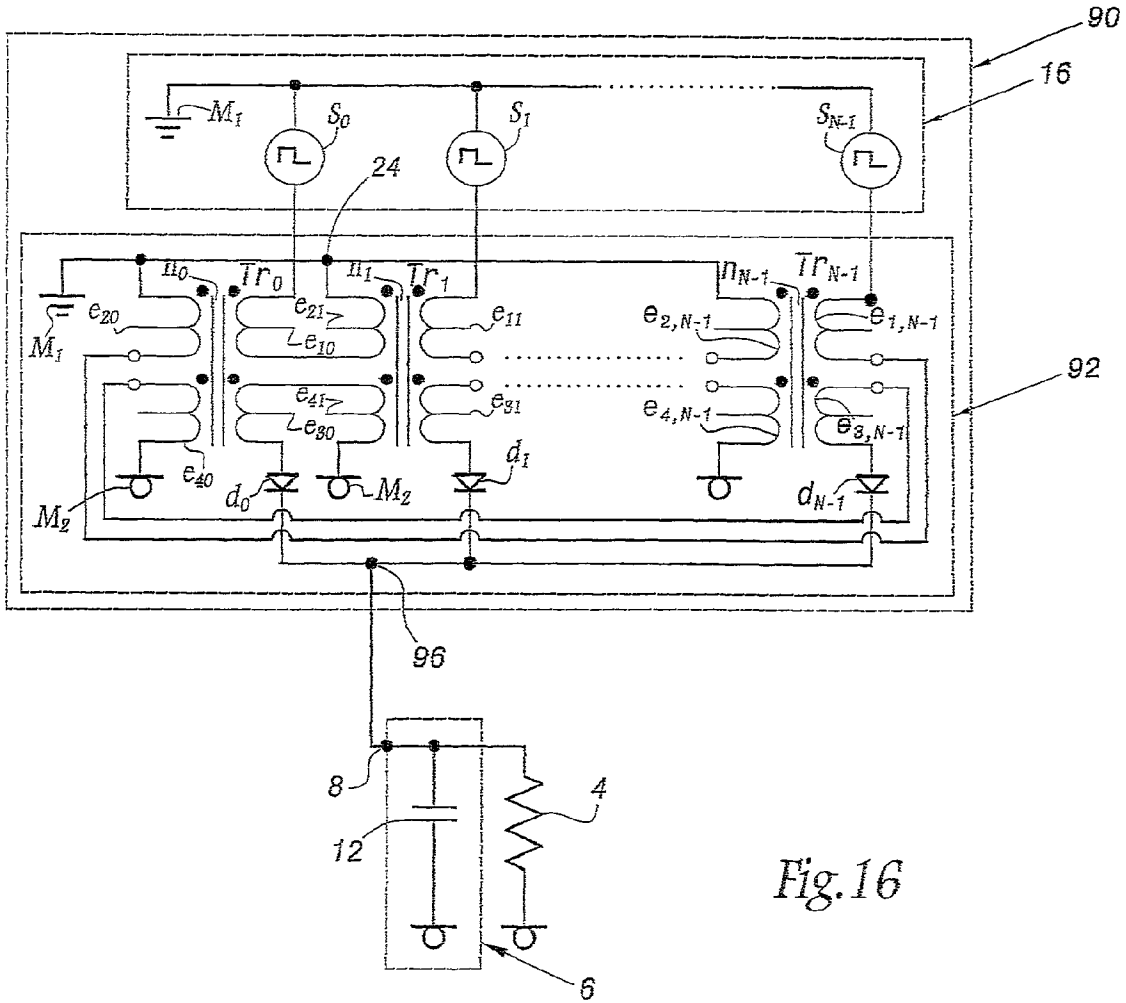
FIG. 16 is a circuit diagram of another embodiment of a device for powering an electric dipole by means of a multi-interphase transformer.

FIG. 16 shows a third embodiment of a device 90 for supplying the dipole 4. In this figure, the elements already described with reference to FIG. 1 have the same reference numerals, and only the differences from the device 2 are discussed here.

In FIG. 16, the filter 6 does not have to exhibit any inductance.

The device 90 comprises the power source 16 connected to the dipole 4 via a multi-interface transformer 92.

In the multi-interphase transformer 92, the central point 24 is connected to a reference potential $M_1$ and no longer to the input 8 of the filter 6.

In this embodiment, each transformer $Tr_i$ comprises, in addition to the pair of windings $e_{1i}$ and $e_{2i}$, a pair of windings $e_{3i}$ and $e_{4i}$. The windings $e_{3i}$ and $e_{4i}$ are magnetically coupled to the windings $e_{1i}$ and $e_{2i}$ via the magnetic core $n_i$. The pair of windings $e_{3i}$ and $e_{4i}$ is electrically insulated from the windings $e_{1i}$ and $e_{2i}$.

One end of the winding $e_{3i}$ is connected via a diode $d_i$ to a common point 96. The cathode of the diode $d_i$ is directed towards the common point 96.

The common point 96 is directly connected to the input 8 of the filter 6.

The other end of the winding $e_{3i}$ is directly connected to one end of the winding $e_{4,i+1}$ of the following transformer $Tr_{i+1}$. The end of the winding $e_{4,i+1}$ which is not connected to the winding $e_{3i}$ is connected to a reference potential $M_2$ electrically insulated from the potential $M_1$.

The end of the winding $e_{3,N-1}$ which is not connected to the common point 96 is directly connected to one end of the winding $e_{40}$.

The design and supply procedure for the multi-interphase transformer 92 is the same as that described with reference to FIG. 5, so as to reduce the overall size of said multi-interphase transformer. In particular, the estimate of the angular offset $w_i$ of a cell is obtained, using only the supply voltages of the windings $e_{1i}$ and $e_{2i}$. In order to return to the previous case of two windings per cell, it is possible to equate the parts of the windings $e_{1i}$, $e_{3i}$ and $e_{2i}$, $e_{4i}$ respectively to the windings $e_{1i}$ and $e_{2i}$ of FIG. 1.

Figure 17:
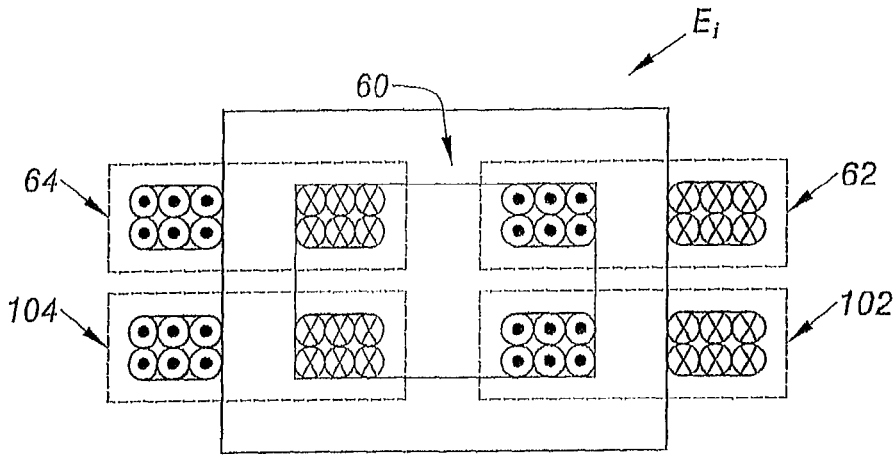
FIGS. 17 and 18 are schematic diagrams of different embodiments of elementary magnetic cells which can be used to form a multi-interphase transformer usable in the device in FIG. 16.

FIG. 17 shows an example of cells $E_i$ which can be used to form the multi-interphase transformer 92. This cell $E_i$ is identical to the cell $A'_i$ except that the windings 62 and 64 have been doubled up. In FIG. 17, the doubles of the windings 62 and 64 have the reference numerals 102 and 104 respectively.

The windings 102 and 104 are wound around the core 60 in the same direction as the windings 62 and 64 respectively. These windings 102 and 104 are electrically insulated from the windings 62 and 64 and magnetically coupled to these windings via the core 60. The windings 62 and 64 correspond to the windings $e_{1i}$ and $e_{2i}$ respectively of FIG. 16 and the windings 102 and 104 correspond to the windings $e_{3i}$ and $e_{4i}$ respectively of FIG. 16.

Figure 18:
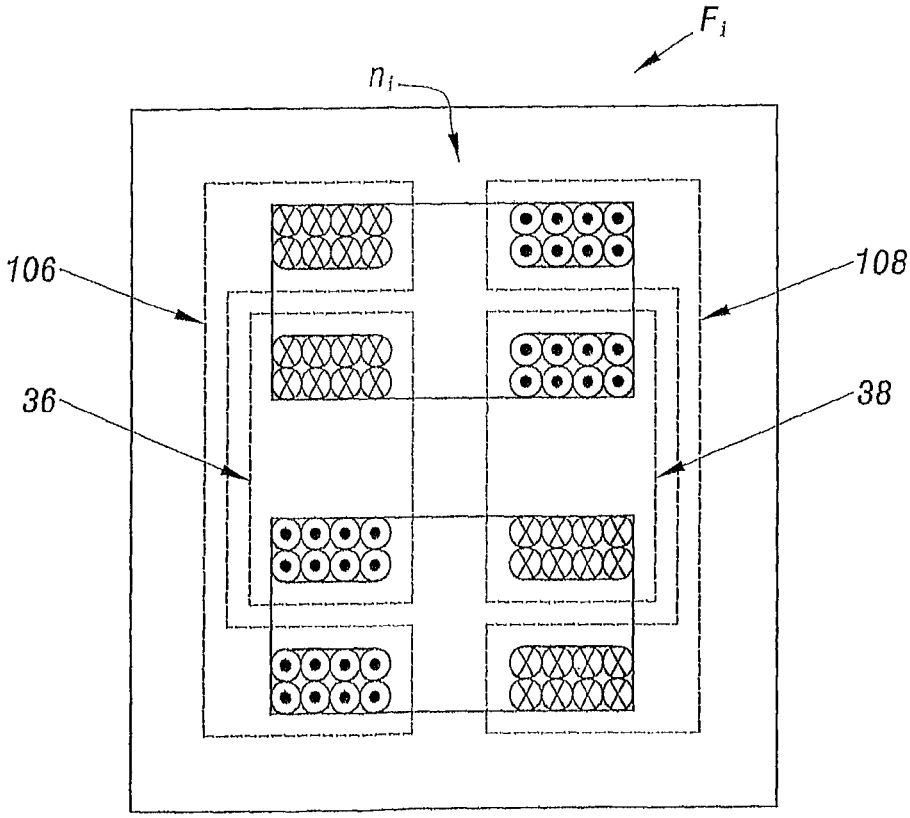

FIG. 18 shows the construction of a cell $F_i$ which can likewise be used to produce the multi-interphase transformer 92.

This cell $F_i$ is identical to the cell $C_i$ except that the windings 36 and 38 have been doubled up. The doubles of the windings 36 and 38 have the reference numerals 106 and 108 respectively. In this embodiment, the winding 106 is only wound around the winding 36 and the winding 108 is only wound around the winding 38. The windings 106 and 108 are electrically insulated from the windings 36 and 38 and magnetically coupled to these windings 36 and 38 via the core $n_i$.

Figure 19:
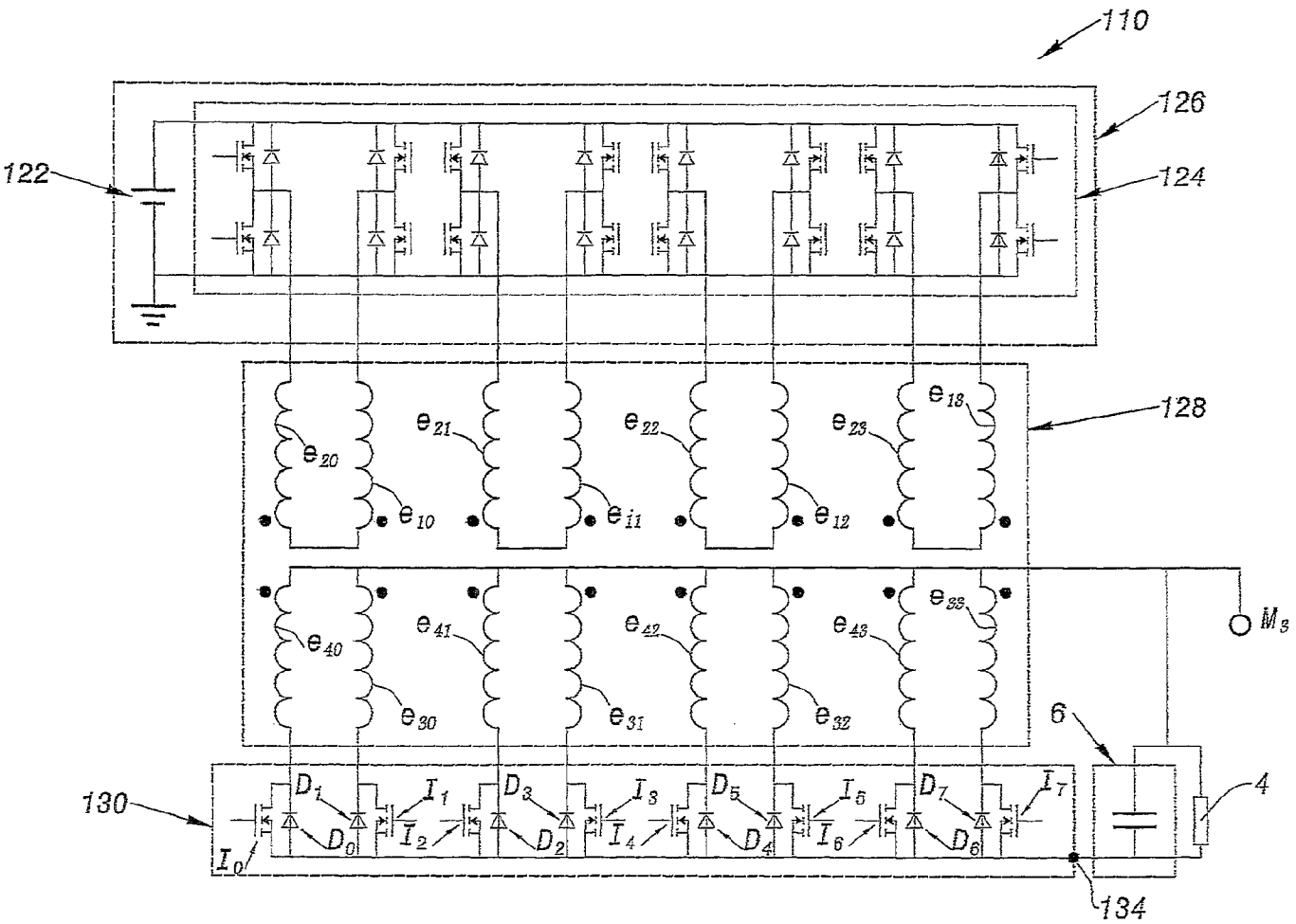
FIGS. 19 and 20 are circuit diagrams of a DC-DC converter using the same multi-interphase transformer as that used in the device in FIG. 16.

FIG. 19 shows the architecture of a DC-DC converter using a multi-interphase transformer as described with reference to the previous figures.

The converter 110 comprises a continuous power source 122 connected to the input of an inverter 124 which converts the continuous voltage provided by the source 122 into N periodic tensions which are angularly offset from one another by $$\frac{2\pi}{N} \text{ rad.}$$

The inverter 124 is in this case a bidirectional current inverter. This inverter is known and the construction thereof will not be described in detail here.

The connection of the source 122 and the inverter 124 thus forms a multiphase power source 126. The source 126 is connected to a multi-interphase transformer 128 with galvanic insulation similar to that of the multi-interphase transformer 92. However, in this embodiment, one end of each winding $e_{1i}$ and $e_{2i}$ is connected directly to a respective phase of the source 126. The other ends of each of these windings $e_{1i}$ and $e_{2i}$ are electrically interconnected.

One end of each of the windings $e_{3i}$ and $e_{4i}$ is connected to a respective input of a voltage rectifier 130. The other end of these windings $e_{3i}$ and $e_{4i}$ is connected to a reference potential $M_3$.

The rectifier 130 comprises the same number of branches and of inputs receiving the voltage supplied by the winding $e_{3i}$ and $e_{4i}$. Each branch is formed of a controlable switch $I_i$ and a diode $D_i$ connected in parallel. The controlable switch $I_i$ is a switch which only allows current to circulate in one direction from the input which is connected to the winding $e_{3i}$ or $e_{4i}$ to a common point 134. The different controlable switches of the rectifier 130 are controlled in such a way as to rectify the voltage supplied by each of the windings $e_{3i}$ and $e_{4i}$. In this embodiment, the dipole 4 is connected between the common point 134 and the reference potential $M_3$.

The rectifier 130 is in this case a bidirectional current rectifier.

Figure 20:
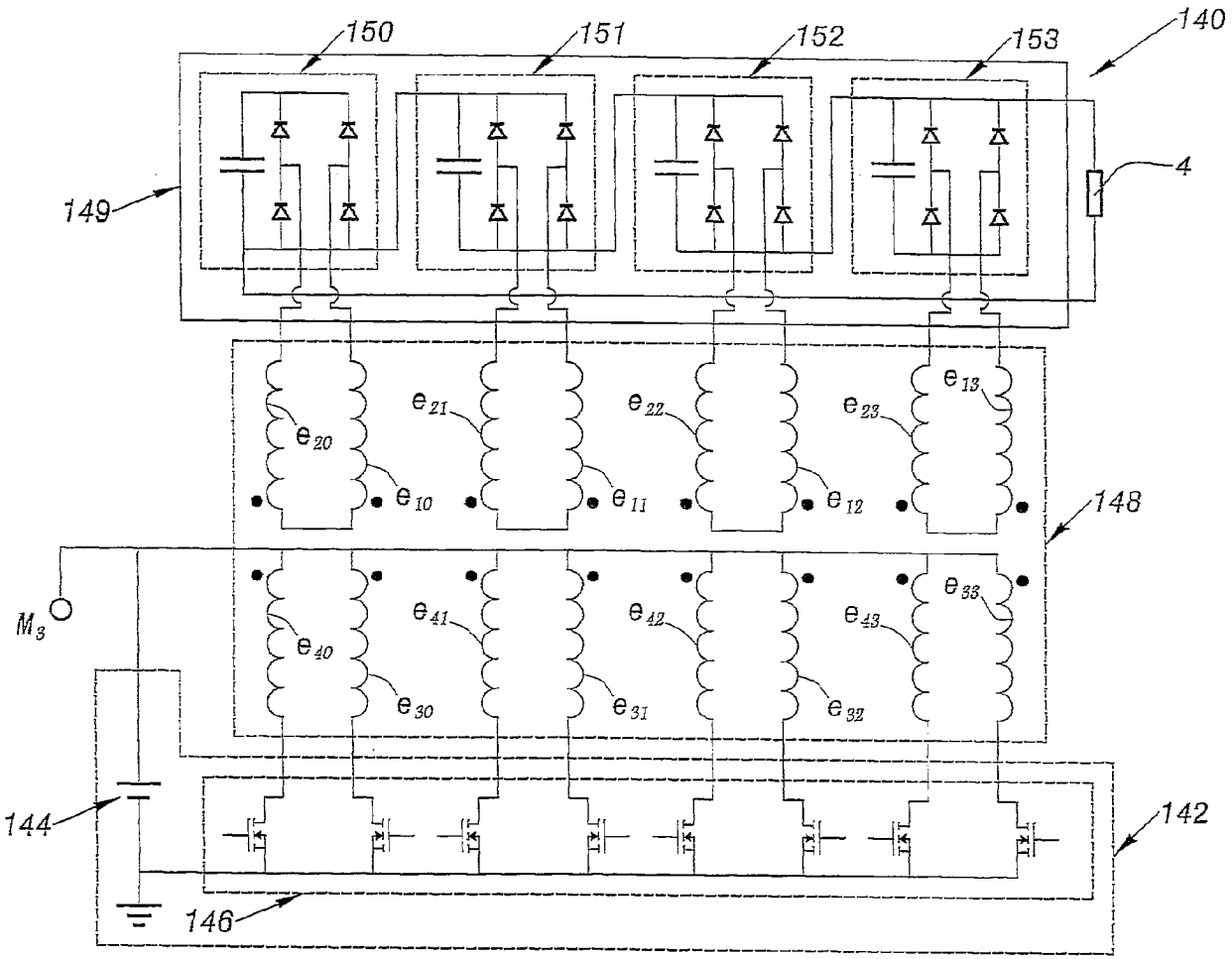

FIG. 20 shows another embodiment of a DC-DC converter 140. This converter 140 comprises a multiphase power source 142 made up of a continuous voltage source 144 connected to the input of an inverter 146. In this case, for example, the inverter 146 has unidirectional current. Each output of the inverter 146 is connected to a respective winding of a multi-interphase transformer 148. The multi-interphase transformer 148 is identical to the multi-interphase transformer 128 except that in the multi-interphase transformer 128, it is the ends of the windings $e_{3i}$ and $e_{4i}$ that are connected to the respective phases of the source 142. For this reason, during the operation of estimating the angular offset $x_i$ of each of the cells, the windings $e_{3i}$ and $e_{4i}$ as well as the supply voltages thereof are to be taken into account.

In this case, the outputs of the multi-interphase transformer 148 are connected to a voltage rectifier/step-up transformer 149. For example, the voltage rectifier/step-up transformer 149 may be formed of a plurality of step-up transformer stages 150 to 153. Each step-up transformer stage receives the voltages generated by a pair of coils $e_{1i}$, and $e_{2i}$ respectively in order to step up a volage received at the input. A rectifier/step-up transformer of this type is known and therefore will not be described in greater detail. The load 4 is connected to the output of this rectifier/step-up transformer 149.

Many other embodiments are possible. Here, each multi-interphase transformer has been described in the case where it is produced by gluing or fixing a plurality of elementary magnetic cells to one another. In a variant, the multi-interphase transformer has exactly the same construction as that described here, but is produced by joining a succession of magnetic cores behind one another in an E-shape. More precisely, the free ends of the horizontal bars of the E-shaped portion are joined to the vertical rear face of the following E-shaped core. The free ends of the horizontal bars of the last E-shaped core in the stack are magnetically connected via a vertical I-shaped bar. The construction of the multi-interphase transformer thus obtained is identical to that obtained by joining cells such as the cells $C_i$, for example. Thus, a multi-interphase transformer of this type can be broken down into elementary cells identical to those described here. From this point, it is possible to locate, within this multi-interphase transformer, portions of the core corresponding to each of the bars $B_{ij}$. However, in this case, the joined bars $B_{ij}$ and $B_{ij+1}$ come from the same material as one another, i.e. are formed in a single block. The teaching described previously can therefore be applied to a multi-interphase transformer of this type to determine what phase of the power source each winding must be connected to in order to minimise the maximum magnetic flux in the joined bars.

It is also possible to produce a multi-interphase transformer, having one of the constructions described here, from a core in a single block in which the number of openings provided is the same as the number of windows 32, 34 required. In this last embodiment, no gluing between different cells is required. However, a multi-interphase transformer of this type can nevertheless still be broken down into elementary cells of the type described here. Thus, the teaching provided in this description can be applied to this embodiment to determine what phases of the voltage source each of the windings must be connected to in order to minimise the maximum magnetic flux in the joined bars.

A multi-interphase transformer with reduced overall size may also be produced by joining a plurality of cells in the vertical direction alone.

In this case, the multi-interphase transformer comprises the same number of windings $e_{1i}$ and $e_{2i}$ and phases of the power source. In a variant, each winding $e_{1i}$ and $e_{2i}$ is divided into a plurality of windings $e_{1ik}$ and $e_{2ik}$ respectively which are connected in series. Each winding $e_{1ik}$ and $e_{2ik}$ is subsequently used in a different cell. However, the number of windings $e_{1ik}$ and $e_{2ik}$ connected in series preferably remains less than N.

The embodiments of the multi-interphase transformers described here are based on the particular case where the teaching of the patent application FR 05 07 136 is used within each cell in such a way as to reduce even further the overall size of each of these cells (rule a) as described with reference to FIG. 5). However, in a variant, only rule b) as described with reference to the same figure is used to reduce the overall size of the multi-interphase transformer.

If a cell comprises two windings, the turns of these windings may be interlaced. This decreases the alternative resistance of the windings.

The planar face of the joined bars may comprise roughnesses or irregularites making it easier to couple and fix the cells to one another.

The bars around which coils are wound are not necessarily straight but may be curved.

Finally, it is also possible to use different types of cells in a single multi-interphase transformer.

The different embodiments described here have the following advantages:

- the application of rule b) for each joined bar makes it possible to reduce very distinctly the overall size and losses of the multi-interphase transformer,
- selecting the supply voltages of the windings in such a way that the difference between the angular offsets $x_i$ and $x_j$ of the magnetising fluxes generated by two joined cells is between $$\pi - \frac{2\pi}{N} \text{ and } \pi + \frac{2\pi}{N} \text{ rad}$$

makes it possible to maximise the decrease in the overall size of the multi-interphase transformer,
- dividing each winding $e_{1i}$ connected to a phase of the power source into a plurality of windings $e_{1ik}$ connected in series makes it possible to reduce the number of windings available to create cells, and thus to improve the possibility of approximation to an optimal configuration in which the difference in angular offsets $x_i$-$x_j$ is equal to or very close to π rad.

Annex

TABLE 1

| $C_0$ | | $C_1$ | | $C_2$ | | $C_3$ | | $C_4$ | | $C_5$ | | $C_6$ | | $C_7$ | | $C_8$ | | $C_9$ | | $C_{10}$ | | $C_{11}$ | |
|---|---|---|---|---|---|---|---|---|---|---|---|---|---|---|---|---|---|---|---|---|---|---|---|
| $V_0$ | $-V_5$ | $V_5$ | $-V_{10}$ | $V_{10}$ | $-V_3$ | $V_3$ | $-V_8$ | $V_8$ | $-V_1$ | $V_1$ | $-V_6$ | $V_6$ | $-V_{11}$ | $V_{11}$ | $-V_4$ | $V_4$ | $-V_9$ | $V_9$ | $-V_2$ | $V_2$ | $-V_7$ | $V_7$ | $-V_0$ |

TABLE 4

| $C_0$ | | $C_6$ | | $C_5$ | | $C_{11}$ | | $C_{10}$ | | $C_4$ | | $C_3$ | | $C_9$ | | $C_8$ | | $C_2$ | | $C_1$ | | $C_7$ | |
|---|---|---|---|---|---|---|---|---|---|---|---|---|---|---|---|---|---|---|---|---|---|---|---|
| $V_0$ | $-V_5$ | $V_{11}$ | $-V_6$ | $V_1$ | $-V_6$ | $V_0$ | $-V_7$ | $V_2$ | $-V_7$ | $V_1$ | $-V_8$ | $V_3$ | $-V_8$ | $V_2$ | $-V_9$ | $V_4$ | $-V_9$ | $V_3$ | $-V_{10}$ | $V_5$ | $-V_{10}$ | $V_4$ | $-V_{11}$ |

TABLE 5

| $C_0$ | | $C_6$ | | $C_5$ | | $C_{11}$ | | $C_{10}$ | | $C_4$ | | $C_3$ | | $C_9$ | | $C_8$ | | $C_2$ | | $C_1$ | | $C_7$ | |
|---|---|---|---|---|---|---|---|---|---|---|---|---|---|---|---|---|---|---|---|---|---|---|---|
| $V_0$ | $-V_5$ | $-V_6$ | $V_{11}$ | $V_1$ | $-V_6$ | $-V_7$ | $V_0$ | $V_2$ | $-V_7$ | $-V_8$ | $V_1$ | $V_3$ | $-V_8$ | $-V_9$ | $V_2$ | $V_4$ | $-V_9$ | $-V_{10}$ | $V_3$ | $V_5$ | $-V_{10}$ | $-V_{11}$ | $V_4$ |

TABLE 6

| Number of cells a multiple of 4 | | | | | | | | | | | | | | | | | | | | | | | |
|---|---|---|---|---|---|---|---|---|---|---|---|---|---|---|---|---|---|---|---|---|---|---|---|
| N | $C_0$ | | $C_1$ | | $C_2$ | | $C_3$ | | $C_4$ | | $C_5$ | | $C_6$ | | $C_7$ | | $C_8$ | | $C_9$ | | | | |
| 4 | 1 | −2 | −3 | 4 | 2 | −3 | −4 | 1 | | | | | | | | | | | | | | | |
| 8 | 1 | −4 | −5 | 8 | 2 | −5 | −6 | 1 | 3 | −6 | −7 | 2 | 4 | −7 | −8 | 3 | | | | | | | |
| 12 | 1 | −6 | −7 | 12 | 2 | −7 | −8 | 1 | 3 | −8 | −9 | 2 | 4 | −9 | −10 | 3 | 5 | −10 | −11 | 4 | | | |
| 16 | 1 | −8 | −9 | 16 | 2 | −9 | −10 | 1 | 3 | −10 | −11 | 2 | 4 | −11 | −12 | 3 | 5 | −12 | −13 | 4 | | | |
| 20 | 1 | −10 | −11 | 20 | 2 | −11 | −12 | 1 | 3 | −12 | −13 | 2 | 4 | −13 | −14 | 3 | 5 | −14 | −15 | 4 | | | |
| N | $C_{10}$ | | $C_{11}$ | | $C_{12}$ | | $C_{13}$ | | $C_{14}$ | | $C_{15}$ | | $C_{16}$ | | $C_{17}$ | | $C_{18}$ | | $C_{19}$ | | | | |
| 4 | | | | | | | | | | | | | | | | | | | | | | | |
| 8 | | | | | | | | | | | | | | | | | | | | | | | |
| 12 | 6 | −11 | −12 | 5 | | | | | | | | | | | | | | | | | | | |
| 16 | 6 | −13 | −14 | 5 | 7 | −14 | −15 | 6 | 8 | −15 | −16 | 7 | | | | | | | | | | | |
| 20 | 6 | −15 | −16 | 5 | 7 | −16 | −17 | 6 | 8 | −17 | −18 | 7 | 9 | −18 | −19 | 8 | 10 | −19 | −20 | 9 | | | |

TABLE 7

| Odd number of cells | | | | | | | | | | | | | | | | | | | | | | | |
|---|---|---|---|---|---|---|---|---|---|---|---|---|---|---|---|---|---|---|---|---|---|---|---|
| N | $C_0$ | | $C_1$ | | $C_2$ | | $C_3$ | | $C_4$ | | $C_5$ | | $C_6$ | | $C_7$ | | $C_8$ | | $C_9$ | | | | |
| 5 | 1 | −3 | −3 | 5 | 5 | −2 | −2 | 4 | 4 | −1 | | | | | | | | | | | | | |
| 7 | 1 | −4 | −4 | 7 | 7 | −3 | −3 | 6 | 6 | −2 | −2 | 5 | 5 | −1 | | | | | | | | | |
| 9 | 1 | −5 | −5 | 9 | 9 | −4 | −4 | 8 | 8 | −3 | −3 | 7 | 7 | −2 | −2 | 6 | 6 | −1 | | | | | |
| 11 | 1 | −6 | −6 | 11 | 11 | −5 | −5 | 10 | 10 | −4 | −4 | 9 | 9 | −3 | −3 | 8 | 8 | −2 | −2 | 7 | | | |
| 13 | 1 | −7 | −7 | 13 | 13 | −6 | −6 | 12 | 12 | −5 | −5 | 11 | 11 | −4 | −4 | 10 | 10 | −3 | −3 | 9 | | | |
| 15 | 1 | −8 | −8 | 15 | 15 | −7 | −7 | 14 | 14 | −6 | −6 | 13 | 13 | −5 | −5 | 12 | 12 | −4 | −4 | 11 | | | |
| 17 | 1 | −9 | −9 | 17 | 17 | −8 | −8 | 16 | 16 | −7 | −7 | 15 | 15 | −6 | −6 | 14 | 14 | −5 | −5 | 13 | | | |
| 19 | 1 | −10 | −10 | 19 | 19 | −9 | −9 | 18 | 18 | −8 | −8 | 17 | 17 | −7 | −7 | 16 | 16 | −6 | −6 | 15 | | | |
| | | N | $C_{10}$ | | $C_{11}$ | | $C_{12}$ | | $C_{13}$ | | $C_{14}$ | | $C_{15}$ | | $C_{16}$ | | $C_{17}$ | | $C_{18}$ | | | | |
| | | 5 | | | | | | | | | | | | | | | | | | | | | |
| | | 7 | | | | | | | | | | | | | | | | | | | | | |
| | | 9 | | | | | | | | | | | | | | | | | | | | | |
| | | 11 | | 7 | −1 | | | | | | | | | | | | | | | | | | |
| | | 13 | | 9 | −2 | −2 | 8 | 8 | −1 | | | | | | | | | | | | | | |
| | | 15 | | 11 | −3 | −3 | 10 | 10 | −2 | −2 | 9 | 9 | −1 | | | | | | | | | | |
| | | 17 | | 13 | −4 | −4 | 12 | 12 | −3 | −3 | 11 | 11 | −2 | −2 | 10 | 10 | −1 | | | | | | |
| | | 19 | | 15 | −5 | −5 | 14 | 14 | −4 | −4 | 13 | 13 | −3 | −3 | 12 | 12 | −2 | −2 | 11 | 11 | −1 | | |

TABLE 8

| $C_0$ | | $C_6$ | | $C_5$ | | $C_{11}$ | | $C_{10}$ | | $C_4$ | | $C_3$ | | $C_9$ | | $C_8$ | | $C_2$ | | $C_1$ | | $C_7$ | |
|---|---|---|---|---|---|---|---|---|---|---|---|---|---|---|---|---|---|---|---|---|---|---|---|
| $V_0$ | $-V_5$ | $-V_6$ | $V_{11}$ | $-V_1$ | $V_6$ | $V_7$ | $-V_0$ | $V_2$ | $-V_7$ | $-V_8$ | $V_1$ | $-V_3$ | $V_8$ | $V_9$ | $-V_2$ | $V_4$ | $-V_9$ | $-V_{10}$ | $V_3$ | $-V_5$ | $V_{10}$ | $V_{11}$ | $-V_4$ |

The invention claimed is:

1. Device for powering an electric dipole, comprising:

a power source with N phases, the angular offsets between the phases being distributed uniformly between 0 and 2π rad, N being greater than or equal to four and 2π rad representing a period of the voltage or the periodic current, a multi-interphase transformer which can be broken down into at least four elementary magnetic cells, each cell comprising:

a magnetic core suitable for forming a single closed annular magnetic circuit, said core comprising for this purpose at least three non-co-linear bars forming the closed magnetic circuit, at least two of said bars each having a planar face facing the exterior of the cell, and the field lines of the closed magnetic circuit inside said bars being parallel to the planar faces, one or more windings, each of said windings being wound around a bar of the magnetic core so as to leave at least the two bars with a planar face free of windings, and the elementary cells are joined together in pairs via the respective planar faces thereof so as to form pairs of first and second cells which are magnetically coupled to one another, in which:

a) the or each winding of the first cell is connected to a respective phase of the power source so as to produce, during operation, a magnetizing flux in the bar of the first cell joined to the second cell, the fundamental component of which has an angular offset $x_i$, and b) the or each winding of the second cell is connected to a respective phase of the power source so as to produce, during operation, a magnetizing flux in the bar of the second cell joined to the first cell, the fundamental component of which has an angular offset $x_j$, characterized in that the absolute value of the difference between the angular offsets $x_i$ and $x_j$ is greater than $$\frac{4\pi}{N} \text{ rad.}$$

2. Device according claim 1, wherein the absolute value of the difference between the angular offsets $x_i$ and $x_j$ is between $$\pi - \frac{2\pi}{N} \text{ rad and } \pi + \frac{2\pi}{N} \text{ rad}$$

for each cell.

3. Device according to claim 1, wherein each winding of the second cell is inferred from the corresponding winding of the first cell by means of axial symmetry along an axis which is co-linear with the joined faces.

4. Device according to claim 1, wherein each cell comprises at least one first and one second winding wound in opposite directions around the same bar.

5. Device according to claim 1, wherein each cell comprises at least one first and one second winding, the first winding and the second winding being connected to respective phases of the power source in such a way that, during operation, the angular phase difference between the supply voltages of each of said windings is between $$\pi - \frac{2\pi}{N} \text{ and } \pi + \frac{2\pi}{N}.$$

6. Device for powering an electric dipole, comprising:

a power source with N phases, the angular offsets between the phases being distributed uniformly between 0 and 2π rad, N being greater than or equal to four and 2π rad representing a period of the voltage or the periodic current, a multi-interphase transformer which can be broken down into at least four elementary magnetic cells, each cell comprising:

a magnetic core suitable for forming only a first and a second closed annular magnetic circuit with a common portion, said core comprising a central magnetic bar forming the common portion of the two closed magnetic circuits, and at least two non-colinear bars each having a planar face facing towards the exterior of the cell, and the field lines of the first or second closed magnetic circuit inside said bars being parallel to the planar face thereof, one or more windings, each of said windings being wound around the central bar so as to leave at least the two bars with a planar face free of windings, and the elementary cells are joined together in pairs via the respective planar faces thereof so as to form pairs of first and second cells which are magnetically coupled to one another, in which:

a) the or each winding of the first cell is connected to a respective phase of the power source so as to produce, during operation, a magnetizing flux in the bar of the first cell joined to the second cell, the fundamental component of which has an angular offset $x_i$, and b) the or each winding of the second cell is connected to a respective phase of the power source so as to produce, during operation, a magnetizing flux in the bar of the second cell joined to the first cell, the fundamental component of which has an angular offset $x_j$, characterized in that the absolute value of the difference between the angular offsets $x_i$ and $x_j$ is greater than $$\frac{4\pi}{N} \text{ rad.}$$

7. Device according to claim 6, wherein the absolute value of the difference between the angular offsets $x_i$ and $x_j$ is between $$\pi - \frac{2\pi}{N} \text{ rad and } \pi + \frac{2\pi}{N} \text{ rad}$$

for each cell.

8. Device according to claim 6, wherein each winding of the second cell is inferred from the corresponding winding of the first cell by means of axial symmetry along an axis which is co-linear with the joined faces.

9. Device according to claim 6, wherein each cell comprises at least one first and one second winding wound in opposite directions around the same bar.

10. Device according to claim 6, wherein each cell comprises at least one first and one second winding ($e_{1i}$, $e_{21}$), the first winding and the second winding being connected to respective phases of the power source in such a way that, during operation, the angular phase difference between the supply voltages of each of said windings is between $$\pi - \frac{2\pi}{N} \text{ and } \pi + \frac{2\pi}{N}.$$

11. Method of powering a multi-interphase transformer which can be broken down into at least four elementary magnetic cells, each cell comprising:

a magnetic core suitable for forming a single closed annular magnetic circuit, said core comprising for this purpose at least three non-co-linear bars forming the closed magnetic circuit, at least two of said bars each having a planar face facing the exterior of the cell, and the field lines of the closed magnetic circuit inside said bars being parallel to the planar faces, one or more windings, each of said windings being wound around a bar of the magnetic core so as to leave at least the two bars with a planar face free of windings, and the elementary cells are joined together in pairs via the respective planar faces thereof so as to form pairs of first and second cells which are magnetically coupled to one another, this method consisting of powering said multi-interphase transformer by using N periodic supply voltages or currents which are offset angularly from one another, the angular offsets between the N supply voltages or currents used being distributed uniformly between 0 and 2π rad, N being an integer greater than or equal to four and 2π rad representing a period of the voltage or the periodic current, and more specifically consisting of:

a) powering the or each winding of the first cell with one of the supply voltages or currents respectively so as to produce a magnetizing flux in the bar of the first cell joined to the second cell, the fundamental component of which has an angular offset $x_i$, and b) powering the or each winding of the second cell with one of the supply voltages or currents respectively so as to produce a magnetizing flux in the bar of the second cell joined to the first cell, the fundamental component of which has an angular offset $x_j$, characterised in that the absolute value of the difference between the angular offsets $x_i$ and $x_j$ is greater than or equal to $$\frac{4\pi}{N} \text{ rad.}$$

12. Method according to claim 11, wherein the absolute value of the difference between the angular offsets $x_i$ and $x_j$ is between $$\pi - \frac{2\pi}{N} \text{ rad and } \pi + \frac{2\pi}{N} \text{ rad}$$

for each pair of cells.

13. Method according to claim 11, wherein each winding of a cell is connected in series with at least one other winding of another cell.

14. Method of powering a multi-interphase transformer which can be broken down into at least four elementary magnetic cells, each cell comprising:

a magnetic core suitable for forming only a first and a second closed annular magnetic circuit with a common portion, said core comprising a central magnetic bar forming the common portion of the two closed magnetic circuits, and at least two non-co-linear bars each having a planar face facing towards the exterior of the cell, and the field lines of the first or second closed magnetic circuit inside said bars being parallel to the planar face thereof, one or more windings, each of said windings being wound around the central bar so as to leave at least the two bars with a planar face free of windings, and the elementary cells are joined together in pairs via the respective planar faces thereof so as to form pairs of first and second cells which are magnetically coupled to one another, the method consisting of powering said multi-interphase transformer by using N periodic supply voltages or currents which are offset angularly from one another, the angular offsets between the N supply voltages or currents used being distributed uniformly between 0 and 2π rad, N being an integer greater than or equal to four and 2π rad representing a period of the voltage or the periodic current, and more specifically consisting of:

a) powering the or each winding of each first cell with one of the supply voltages or currents respectively so as to produce a magnetizing flux in the bar of the first cell joined to the second cell, the fundamental component of which has an angular offset $x_i$, and b) powering the or each winding of the second cell with one of the supply voltages or currents respectively so as to produce a magnetizing flux in the bar of the second cell joined to the first cell, the fundamental component of which has an angular offset $x_j$, characterized in that the absolute value of the difference between the angular offsets $x_i$ and $x_j$ is greater than $$\frac{4\pi}{N} \text{ rad.}$$

15. Method according to claim 14, wherein the absolute value of the difference between the angular offsets $x_i$ and $x_j$ is between $$\pi - \frac{2\pi}{N} \text{ rad and } \pi + \frac{2\pi}{N} \text{ rad}$$

for each pair of cells.

16. Method according to claim 14, wherein each winding of a cell is connected in series with at least one other winding of another cell.

* * * * *

UNITED STATES PATENT AND TRADEMARK OFFICE

CERTIFICATE OF CORRECTION

PATENT NO. : 8,009,003 B2
APPLICATION NO. : 12/446035
DATED : August 30, 2011
INVENTOR(S) : Laboure et al.

It is certified that error appears in the above-identified patent and that said Letters Patent is hereby corrected as shown below:

On the title page, please amend Item (73) to read as follows:

-- (73) Assignees: Centre National de la Recherche Scientifique (C. N.R.S.), Paris, (FR); Institut National Polytechnique de Toulouse, Toulouse, France; Universite Montpellier 2, Sciences et Techniques, Montpellier, France --

Signed and Sealed this
Sixth Day of December, 2011

David J. Kappos

David J. Kappos
*Director of the United States Patent and Trademark Office*